US009885189B2

(12) United States Patent
Ethier

(10) Patent No.: US 9,885,189 B2
(45) Date of Patent: Feb. 6, 2018

(54) APPARATUS AND METHOD FOR SMOOTHING DRYWALL MUD

(71) Applicant: Dominic Ethier, Revelstoke (CA)

(72) Inventor: Dominic Ethier, Revelstoke (CA)

( * ) Notice: Subject to any disclaimer, the term of this patent is extended or adjusted under 35 U.S.C. 154(b) by 0 days.

(21) Appl. No.: 14/842,468

(22) Filed: Sep. 1, 2015

(65) Prior Publication Data

US 2017/0058539 A1 Mar. 2, 2017

(51) Int. Cl.
*E04F 21/165* (2006.01)
*E04F 21/16* (2006.01)
*B25G 3/38* (2006.01)

(52) U.S. Cl.
CPC ..... *E04F 21/161* (2013.01); *B25G 3/38* (2013.01); *E04F 21/1652* (2013.01); *E04F 21/162* (2013.01); *E04F 21/163* (2013.01); *E04F 21/165* (2013.01)

(58) Field of Classification Search
CPC ... E04F 21/1652; E04F 21/165; E04F 21/162; E04F 21/163; E04F 21/161; B25G 3/38
See application file for complete search history.

(56) References Cited

U.S. PATENT DOCUMENTS 2,666,323 A * 1/1954 Ames ..... E04F 21/165 401/48
2,984,857 A * 5/1961 Ames ..... E04F 21/08 401/5
3,186,056 A * 6/1965 Hoveland ..... E04F 21/08 118/108
3,343,202 A * 9/1967 Ames ..... E04F 21/06 118/100
4,129,407 A * 12/1978 Golls ..... E04F 21/241 15/235.8
4,516,868 A * 5/1985 Molnar ..... E04F 21/06 401/171
4,825,597 A 5/1989 Matechuk
4,907,955 A * 3/1990 Snipes ..... E04F 21/06 15/105.5

(Continued)

FOREIGN PATENT DOCUMENTS

CA 2007430 10/1998
CA 2076330 4/2003

(Continued)

*Primary Examiner* — Babajide Demuren
(74) *Attorney, Agent, or Firm* — Todd A. Rattray; Oyen Wiggs Green & Mutala LLP

(57) ABSTRACT

Apparatus and methods for smoothing and blending drywall mud are provided. The apparatus provides a tool having one or more flexible blades to be applied to unfinished cured drywall mud. The blades may be selectively flexed by driving a displacement member towards or away from the blades. The flexed blades may be used to smooth and feather portions of drywall mud to conceal underlying irregularities and to blend with surrounding drywall. The blades may be biased against the displacement member by biasing mechanisms. The tool may receive multiple blades, including a rough-edged blade for a first pass across the drywall mud and a smooth-edged blade for a subsequent pass across the drywall mud. The blades may be kept in place with connectors which may be flexibly connected to allow for flexion.

20 Claims, 12 Drawing Sheets

(56) References Cited

U.S. PATENT DOCUMENTS 5,122,006 A * 6/1992 MacMillan ..... E04F 21/08 15/235.8
5,544,384 A 8/1996 Forselius et al.
5,814,351 A * 9/1998 Mower ..... E04F 21/06 401/193
6,095,911 A 8/2000 Edens
6,146,039 A * 11/2000 Pool ..... B05C 17/005 401/171
6,325,708 B1 12/2001 Miles
6,874,965 B1 * 4/2005 Mondloch ..... E04F 21/08 15/235.3
6,877,923 B2 * 4/2005 Grayden ..... B43M 11/06 401/193
7,318,716 B2 * 1/2008 Castagnetta, Jr. .. E04F 21/1652 15/235.3
7,497,765 B2 3/2009 Field et al.
7,698,774 B1 * 4/2010 Coon ..... B05C 17/10 15/235.8
8,231,371 B1 * 7/2012 Jalbert ..... E04F 21/1652 118/200
8,555,452 B2 * 10/2013 Murray ..... B05C 17/005 15/235.4
8,647,094 B1 * 2/2014 Jalbert ..... E04F 21/1652 118/200
8,713,787 B2 * 5/2014 Parelius ..... E04F 21/06 267/173
8,747,006 B2 * 6/2014 Payne ..... E04F 21/08 401/137
2001/0000503 A1 4/2001 Beaudry et al.
2004/0259488 A1 12/2004 McArthur et al.
2006/0096101 A1 5/2006 Winkler
2007/0259064 A1 * 11/2007 Mathews ..... E04F 21/06 425/87
2007/0297843 A1 * 12/2007 Castagnetta, Jr. .. E04F 21/1652 401/48
2008/0207099 A1 8/2008 Brown
2012/0304411 A1 12/2012 Croft
2013/0011176 A1 * 1/2013 Horning ..... E04F 21/165 401/143

FOREIGN PATENT DOCUMENTS

CA 2515471 2/2007
CA 2435855 3/2007

* cited by examiner

APPARATUS AND METHOD FOR SMOOTHING DRYWALL MUD

FIELD

This invention relates to drywall finishing tools and methods for using same, and in particular to handheld tools for smoothing and blending drywall mud.

BACKGROUND

Drywall (sometimes referred to as gypsum board, plasterboard, wallboard, or other names) is a commonly-used material in construction projects, particularly for the installation of interior walls and ceilings. Drywall sheets are typically attached to studs with screws, nails, or other fasteners, thereby forming a wall or ceiling covering composed of edge-adjacent drywall sheets. Seams between edge-adjacent drywall sheets are typically covered with tape, and corners between sheets may be covered with corner beads (usually metal and paper L-shaped structures). Tape, corner beads, countersunk screws, and other irregularities in the surface of the drywall are covered by a joint compound, often referred to as "mud".

Mud is often applied in multiple layers, with each layer given time to dry (or cure) and then sanded smooth before the next layer is applied. Sanding dried mud to achieve a substantially seamless, smooth surface which conceals underlying irregularities is generally a lengthy and labor-intensive process. For example, mud is commonly sanded by use of sandpaper, which can take a significant amount of time, require significant physical exertion, and result in significant quantities of airborne dust. The dried mud is commonly feathered (i.e. thinner towards the edges) so that it blends in with the surrounding drywall sheets. Correctly blending the mud often requires a certain degree of experience, since over-sanding an area is a common mistake and may result in damage to the drywall and/or a need to reapply mud.

Accordingly, there is a general desire for apparatus and methods for smoothing dried drywall mud.

SUMMARY

An aspect of the present disclosure provides apparatus for smoothing drywall mud. The apparatus comprises a body having a support and a flexible blade assembly engaged with the body. The blade assembly extends in a transverse direction and is flexible in a flexion direction orthogonal to the transverse direction. The blade assembly has first and second locations which are spaced apart in the transverse direction and which are substantially fixed in the flexion direction relative to the body. The apparatus further comprises a blade adjustment mechanism adjustably coupled between the support and a portion of the blade assembly located between the first and second locations in the transverse direction. The blade adjustment mechanism is adjustable to flex the portion of the blade assembly in the flexion direction.

In some embodiments, the blade adjustment mechanism comprises a displacement member that is movable relative to the support in the flexion direction and is in contact with the portion of the blade assembly. In some embodiments, the displacement member is movable, relative to the support, to a first position wherein contact between the displacement member and the portion of the blade assembly causes a first deformation of the portion of the blade assembly and to a second position wherein the contact between the displacement member and the portion of the blade assembly causes a second deformation of the portion of the blade assembly. In some embodiments, the flexion direction is away from the support.

In some embodiments, the apparatus comprises one or more blade biasing mechanisms. Each blade biasing mechanism is anchored to the blade assembly and biases the blade assembly towards the support. In some embodiments, biasing the blade assembly towards the support comprises biasing the blade assembly in an opposing direction opposed to the flexion direction.

In some embodiments, at least one of the one or more blade biasing mechanisms comprises a rod extending through an aperture in the support. The rod has a first end anchored to the blade assembly and a second end opposite the first end. The aperture in the support is located between the first and second ends. The at least one of the one or more blade biasing mechanisms also comprises a head at the second end of the rod. The head has a width greater than a width of the rod. The at least one of the one or more blade biasing mechanisms also comprises a spring engaged between the head and the support. The spring biases the head away from the support.

In some embodiments, the one or more blade biasing mechanisms comprise a first biasing mechanism and a second biasing mechanism. The first biasing mechanism is located transversely between the blade adjustment mechanism and the first location. The second biasing mechanism is located transversely between the blade adjustment mechanism and the second location.

In some embodiments, the blade assembly is engageable with a plurality of blades. The plurality of blades comprise a first blade extending in the transverse direction and a second blade extending in the transverse direction and spaced apart from the first blade in the flexion direction. In some embodiments, the first blade comprises a rough edge for shaving drywall mud. The rough edge comprises one or more channels for the passage of excess drywall mud. The second blade comprises a smooth edge for smoothing drywall mud. The smooth edge is relatively smooth in comparison to the rough edge.

In some embodiments, the blade assembly comprises one or more connectors. Each of the one or more connectors is engageable with each of the plurality of blades. The one or more connectors are engageable with the plurality of blades at the first and second locations and at a third location of the blade assembly where the blade displacement member is coupled to the blade assembly. In some embodiments, the apparatus comprises one or more biasing mechanisms. Each biasing mechanism is anchored to a connector of the one or more connectors at a biasing location of the blade assembly. The one or more connectors are engageable with the plurality of blades at the one or more biasing locations.

In some embodiments, the one or more connectors comprise a first connector engageable with the plurality of blades at the first location, a second connector engageable with the plurality of blades at the second location, and a third connector engageable with the plurality of blades at the third location. In some embodiments, the apparatus comprises a first biasing mechanism anchored to a first bias connector. The first bias connector is engageable with the plurality of blades at the first bias location. The apparatus further comprises a second bias mechanism anchored to a second bias connector. The second bias connector is engageable with the plurality of blades at a second bias location. The first and second bias mechanisms are configured to bias the plurality of blades towards the support at the corresponding first and second bias locations. In some embodiments, the first biasing location is located transversely between the blade adjustment mechanism and the first location. The second biasing location is located transversely between the blade adjustment mechanism and the second location.

In some embodiments, the one or more connectors comprise a plurality of rigid connectors and the blade assembly comprises one or more relatively flexible mounts connecting the one or more connectors.

In some embodiments, the first connector is slidably anchored to the body at the first location. The first connector has an engagement member receivable by a concavity defined in the body and the concavity extends substantially in the transverse direction. The engagement member is slidable in the transverse direction while received by the concavity.

In some embodiments, the apparatus comprises a handle assembly for engaging a handle extending in a handle direction, one or more support arms connected to the handle assembly and extending from the handle assembly to the body, and a handle biasing mechanism connected to the handle assembly and extending from the handle assembly to the body. The body is rotatably connected to each of the one or more support arms so that the body is rotatable about an axis parallel to the transverse direction. The handle biasing mechanism biases the body towards a rotational position wherein, when one or more blades are engaged with the blade assembly and a handle is engaged by the handle assembly, the one or more blades are offset from the handle direction by an offset angle.

In some embodiments, the displacement member comprises a screw threadably engaged with the support. The screw is rotatable to move in the flexion direction relative to the support.

An aspect of the present disclosure provides a method for smoothing drywall mud with a drywalling tool. The tool has a body, a flexible blade assembly extending in a transverse direction, and a blade adjustment mechanism adjustably coupled between a support of the body and a portion of the blade assembly. The flexible blade assembly is flexible in a flexion direction. The method comprises adjusting the blade adjustment mechanism to flex the portion of the blade assembly in the flexion direction, thereby imparting a curvature to one or more blades of the blade assembly. The method further comprises positioning the one or more blades of the blade assembly against a portion of drywall mud. The method further comprises advancing the one or more blades along the portion of drywall mud to smooth the portion of drywall mud. The smoothed portion of drywall mud has a shape corresponding to the curvature of the one or more blades.

In some embodiments, the blade adjustment mechanism comprises a displacement member that is in contact with the portion of the blade assembly. Flexing the portion of the blade assembly in the flexion direction comprises moving the displacement member, relative to the support, in the flexion direction from a first position to a second position. Contact between the displacement member and the portion of the blade assembly causes a deformation of the portion of the blade assembly. The method further comprises retaining the displacement member in the second position via engagement of the displacement member with the support.

In some embodiments, the displacement member is threadably engaged with the support and moving the displacement member comprises rotating the displacement member to move in the flexion direction relative to the support. In some embodiments, the blade adjustment mechanism comprises a displacement member that is in contact with the portion of the blade assembly, the tool comprises a biasing mechanism anchored to the blade assembly, and flexing the portion of the blade assembly in the flexion direction comprises moving the displacement member, relative to the support, in an opposing direction from a first position to a second position. The opposing direction opposes the flexion direction. Flexing the portion of the blade assembly also comprises biasing the blade assembly towards the support in the opposing direction with the biasing mechanism. Bias exerted by the biasing mechanism on the portion of the blade assembly causes a deformation of the portion of the blade assembly.

In some embodiments, advancing the one or more blades along the portion of drywall mud comprises advancing the first blade along the portion of drywall mud to provide a rough finish to the portion of drywall mud and, after advancing the first blade along the portion of drywall mud, advancing the second blade along the portion of drywall mud to provide a smooth finish to the portion of drywall mud. The smooth finish is relatively smooth in comparison to the rough finish. In some embodiments, the method comprises continuously smoothing a plurality of portions of drywall mud by advancing the first and second blades along the plurality of portions of drywall mud substantially simultaneously.

An aspect of the present disclosure provides another apparatus for smoothing drywall mud. The apparatus comprises a body, a flexible blade assembly movably engaged with the body, and one or more blade biasing mechanisms. The blade assembly extends in a transverse direction and is flexible in a flexion direction orthogonal to the transverse direction. The blade assembly has first and second locations which are spaced apart in the transverse direction and which are substantially fixed in the flexion direction relative to the body. Each blade biasing mechanism is anchored to the blade assembly and biases the blade assembly in the flexion direction. In some embodiments, the flexion direction is away from the body.

In some embodiments, at least one of the one or more blade biasing mechanisms comprises a rod having a first end anchored to the blade assembly and a second end opposite the first end and a spring engaged between the blade assembly and the body. The second end is retained in a cavity defined by the body. The spring biases the blade assembly away from the body and is retained by the rod. In some embodiments, the at least one of the one or more blade biasing mechanisms comprises a head engaged with the second end of the rod. The head is retained by the cavity.

In some embodiments, the body is pivotably engaged with the blade assembly and the one or more blade biasing mechanisms do at least one of: oppose pivoting movement of the body toward the blade assembly and amplify pivoting movement of the body toward the blade assembly.

In some embodiments, the blade assembly comprises one or more connectors. Each of the one or more connectors is engageable with one or more blades. The one or more blades are flexible in the flexion direction while engaged with the one or more connectors. In some embodiments, the one or more blade biasing mechanisms comprise a first biasing mechanism and a second biasing mechanism. The first biasing mechanism has a greater spring constant than the second biasing mechanism. In some embodiments, the first blade biasing mechanism is anchored to a first connector and the second blade biasing mechanism is anchored to a second connector. The first connector permits relatively less flexion of the one or more blades than the second connector. In some embodiments, the first blade biasing mechanism and first connector are located relatively transversely outwardly relative to the second blade biasing mechanism and second connector. In some embodiments, the one or more connectors comprise a plurality of rigid connectors and the blade assembly comprises one or more relatively flexible mounts connecting the one or more connectors.

Further aspects and example embodiments are illustrated in the accompanying drawings and/or described in the following description.

BRIEF DESCRIPTION OF THE DRAWINGS

The accompanying drawings illustrate non-limiting example embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Aspects of the present disclosure provide apparatus and methods for smoothing drywall mud (which may include blending and/or feathering drywall mud). The apparatus provides a drywalling tool having one or more flexible blades to be applied to unfinished dried drywall mud. The blades may be selectively flexed by moving a displacement member relative to the body of the tool. The blades may be biased against the displacement member by biasing mechanisms. The tool may receive multiple blades, including a relatively rough-edged blade for a first pass across the drywall mud and a relatively smooth-edged blade for subsequent pass across the drywall mud. The blades may be kept in place with connectors which may be flexibly connected to allow for flexion.

Figure 1A:
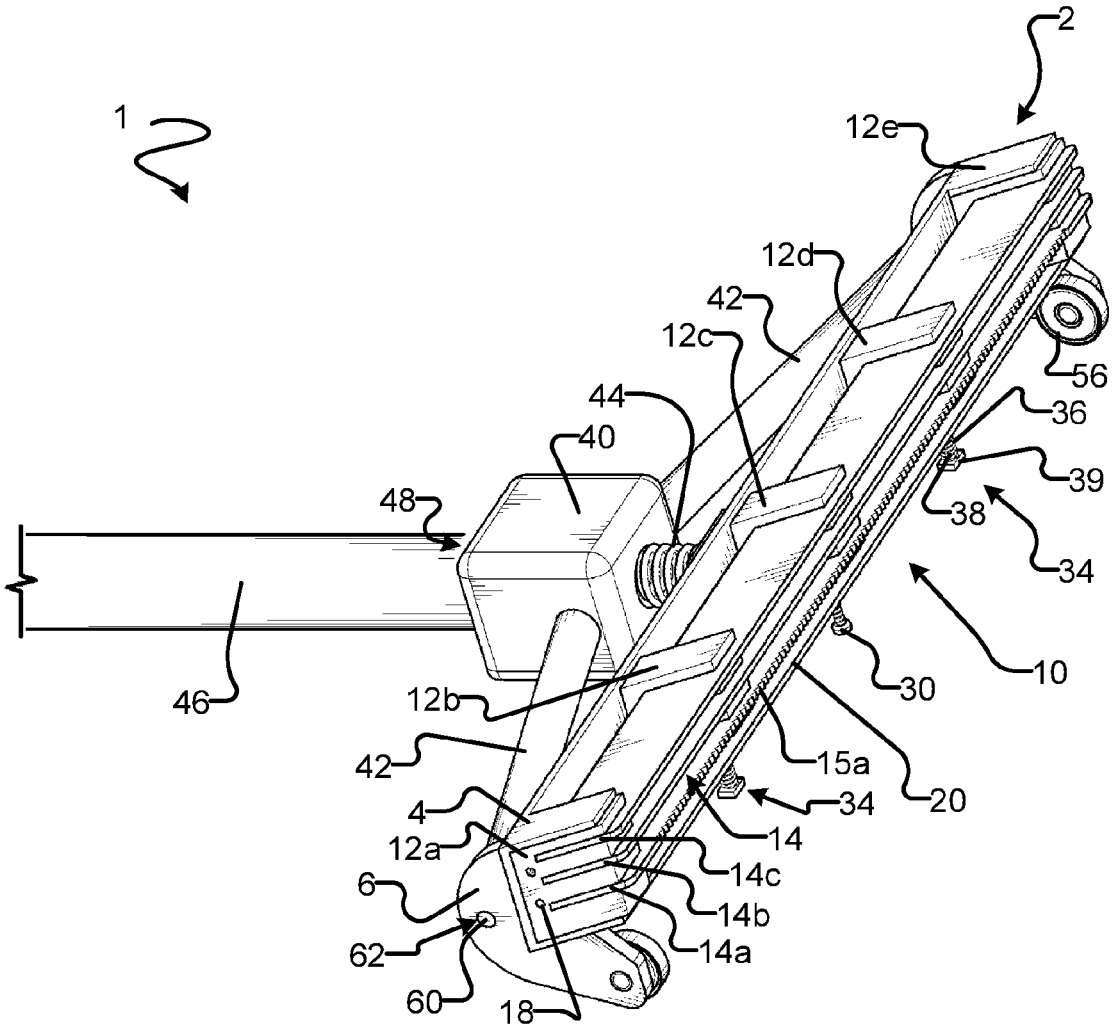
FIG. 1A is a first perspective view of an example drywalling tool according to the present disclosure.
Figure 1B:
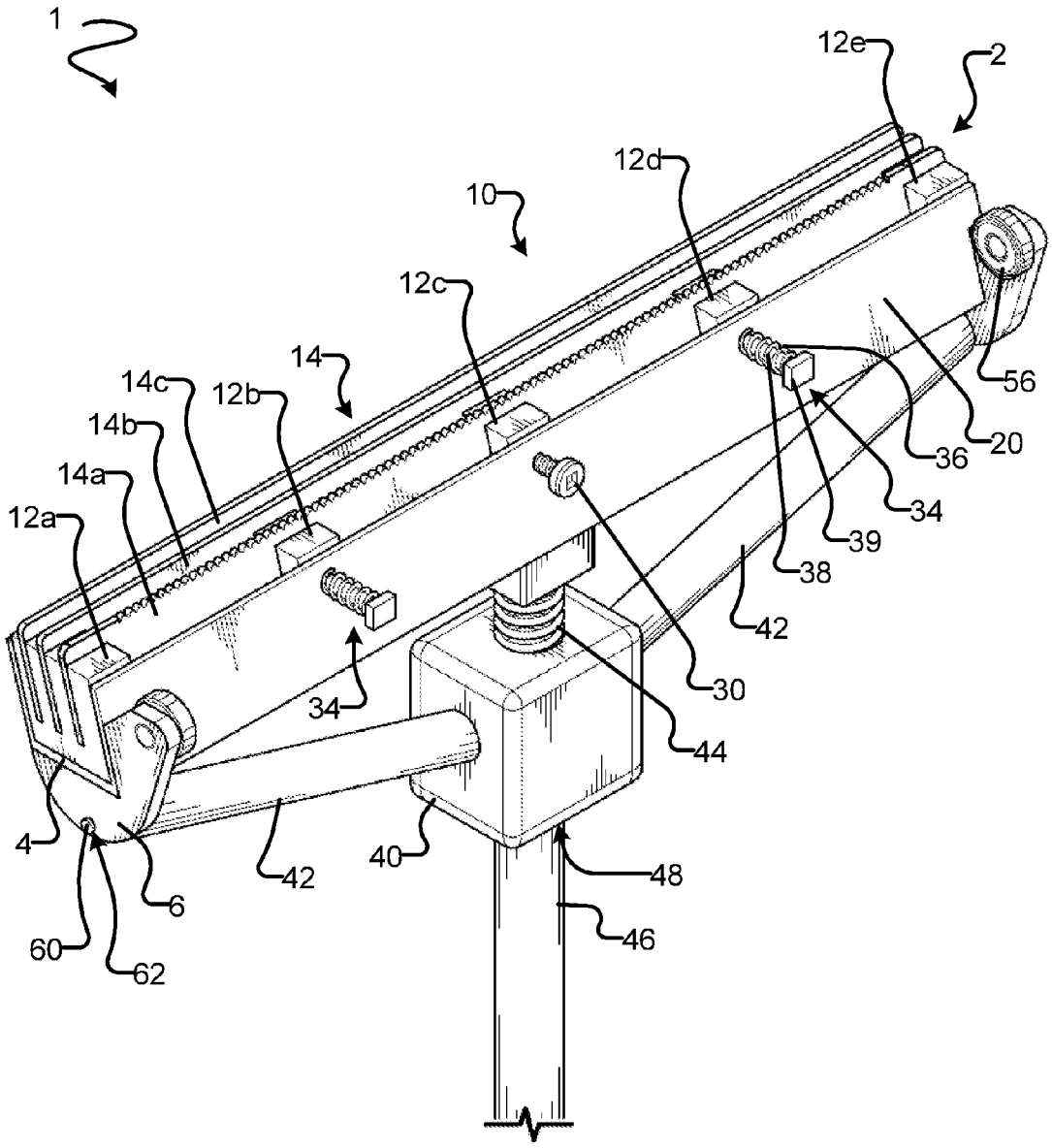
FIG. 1B is a second perspective view of the example drywalling tool of FIG. 1A showing the tool from a different angle than FIG. 1A.
Figure 1C:
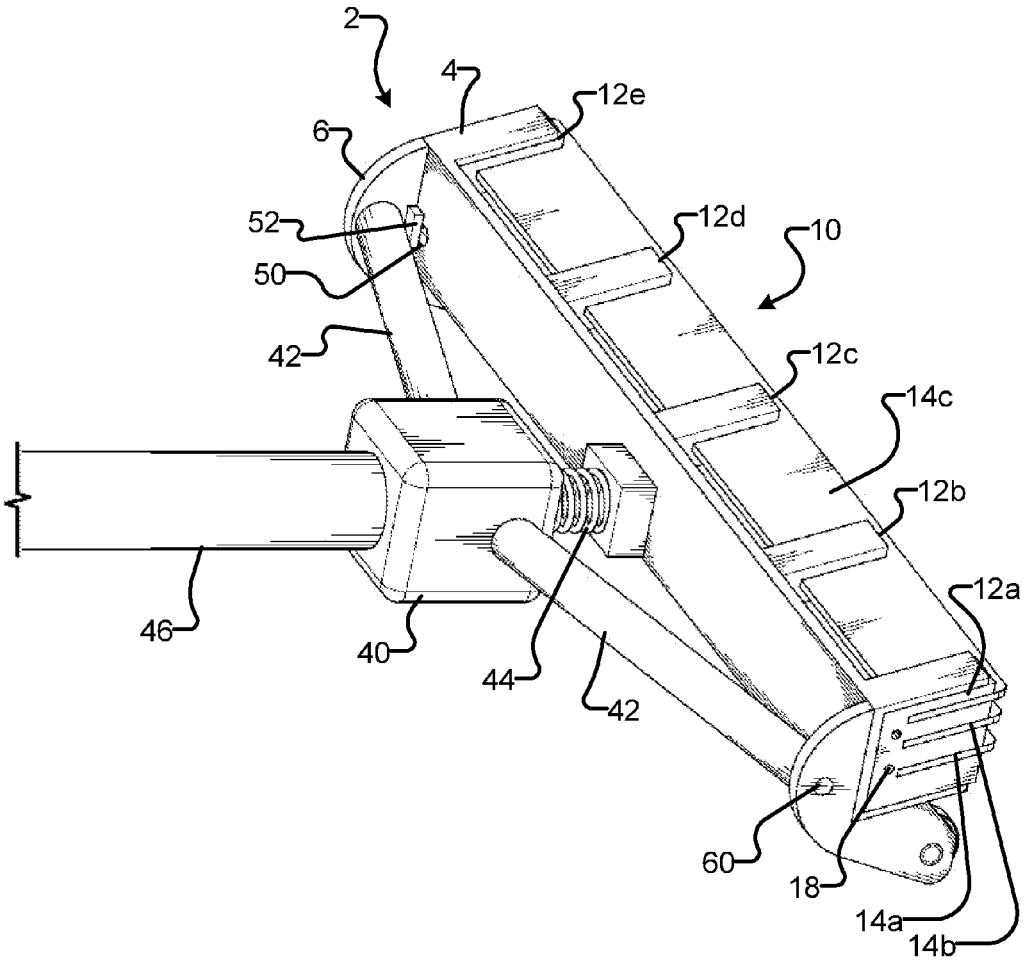
FIG. 1C is a third perspective view of the example drywalling tool of FIG. 1A showing the tool from a different angle than FIGS. 1B and 1C.
Figure 2A:
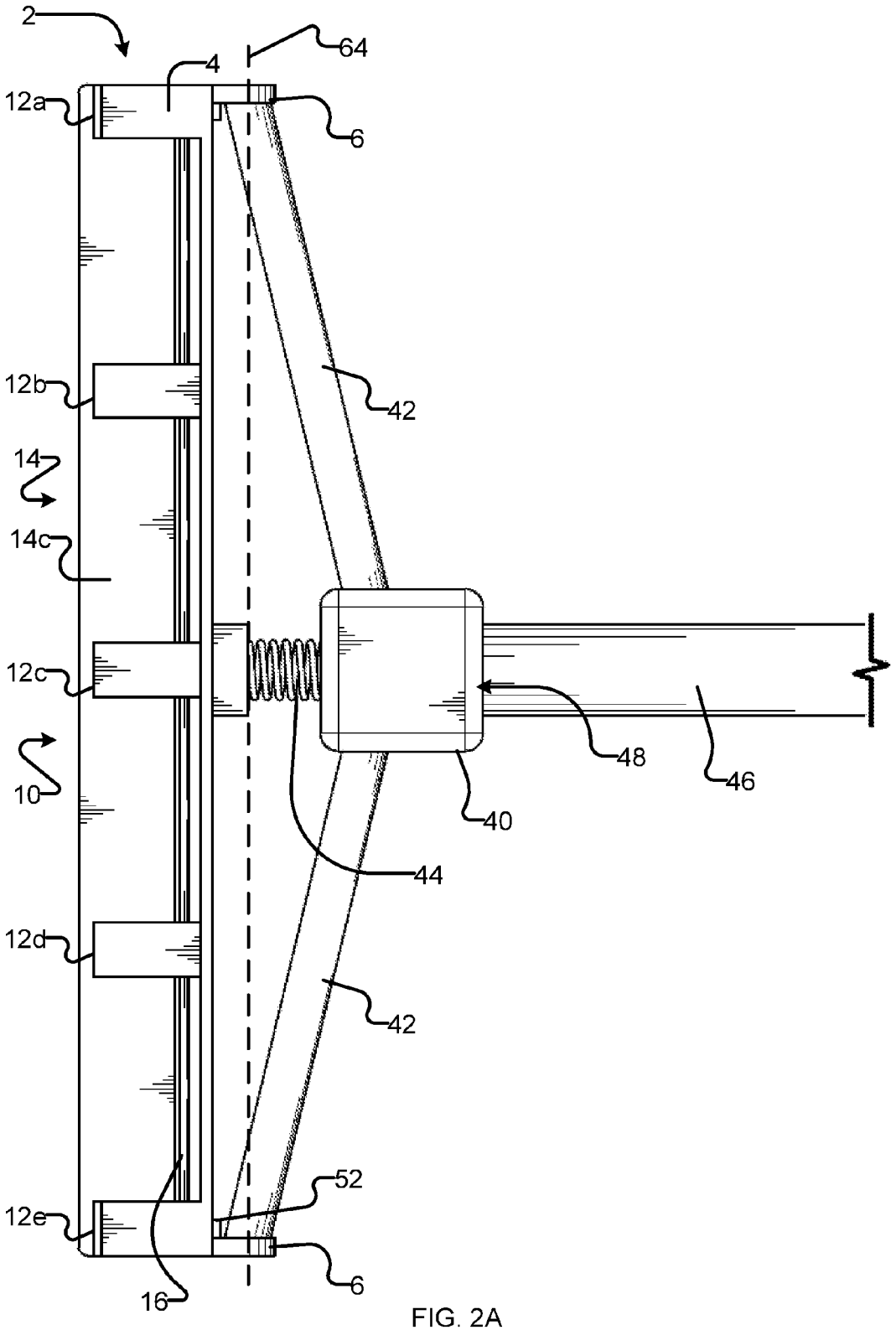
FIG. 2A is a plan view of the example drywalling tool of FIG. 1A.
Figure 2B:
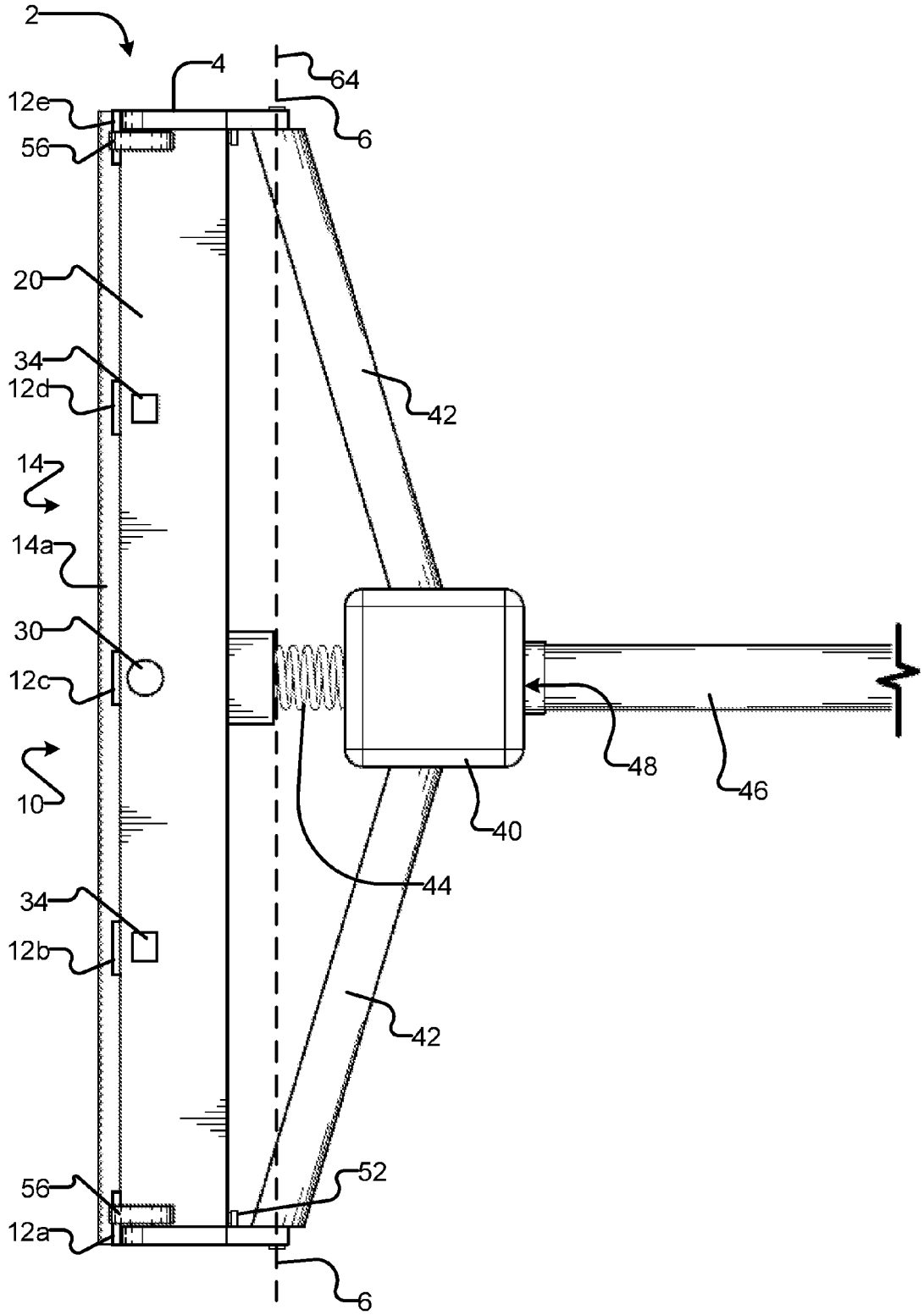
FIG. 2B is a plan view of the example drywalling tool of FIG. 1A showing an opposing side of the tool relative to FIG. 2A.
Figure 3:
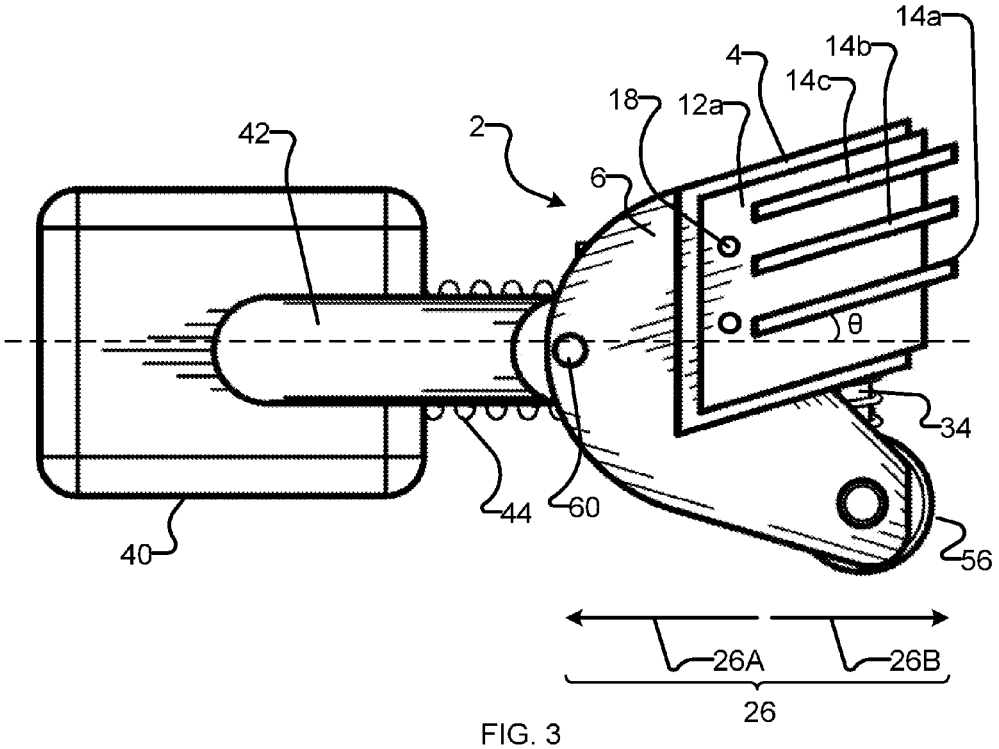
FIG. 3 is a side elevation view of the example drywalling tool of FIG. 1A.

FIGS. 1A, 1B and 1C (collectively and individually, "FIG. 1"), FIGS. 2A and 2B (collectively and individually, "FIG. 2") and FIG. 3 provide several views of an example drywalling tool 1. Drywalling tool 1 has a body 2 which engages a blade assembly 10. In the depicted embodiment, body 2 comprises a blade assembly connector 4 for engaging blade assembly 10 and a frame 6 to which various other elements of tool 1 (such as guide 56 and handle assembly 40, discussed below) are connected. In some embodiments, blade assembly connector 4 and frame 6 are integrally formed. In other embodiments, blade assembly connector 4 and frame 6 are permanently or removably attached. In still other embodiments, frame 6 may be omitted and other elements of tool 1 (if any) may connect directly or indirectly to blade assembly connector 4 and/or to other components of body 2. Body 2 may be made of suitably rigid metal, plastic, wood, other materials and/or combinations thereof.

Blade assembly 10 comprises one or more blades 14. Blade assembly 10 may be permanently or releasably connected to body 2. For example, blade assembly 10 may comprise a cartridge insertable into or otherwise releasably connectable to blade assembly connector 4. As another example, blade assembly 10 may be integrally formed with body 2.

The example blade assembly 10 shown in FIG. 1 receives one or more blades 14, which are releasably connectable to and separately formed from blade assembly 10. In some embodiments, blades 14 are integrally formed with and/or otherwise fixedly attached to blade assembly 10. For example, blades 14 may be fixedly attached to blade assembly 10 by interlocking bolts and apertures. Blade assembly 10 may be provided with a full complement of blades 14 (e.g. three blades 14 in the case of the FIG. 1 embodiment, but any suitable number of blades in other embodiments). However, blade assembly 10 may additionally or alternatively be provided with a number of blades 14 which is less than a full complement of blades 14. In some cases, blade assembly 10 may be provided without blades 14. In these cases (i.e. wherever blade assembly 10 comprises fewer than a full complement of blades 14), blade assembly 10 may receive one or more blades 14 to provide a full complement.

In at least the example embodiment of FIG. 1, blades 14 may be received and held in place by blade assembly 10 during use of tool 1, and may be subsequently removed and/or replaced. Removal and/or replacement of blades 14 may be due to wear, in response to a user's needs, and/or for other reasons. For example, as will be discussed in greater detail below, blades 14 may be provided with a variety of types of leading edges 15, and different leading edges may be preferable in different circumstances. A blade 14 with a relatively rough leading edge 15 may be used on a rough portion of drywall mud and/or to provide relatively coarse smoothing, and may be swapped out for a different blade 14 with a relatively smoother leading edge 15 when finishing a smoother portion of drywall mud and/or to provide relatively fine smoothing.

In some embodiments, blade assembly 10 houses a plurality of blades 14. For example, blade assembly 10 may house blades 14*a*, 14*b*, and 14*c* (referred to collectively and individually herein as blades 14), as shown in FIGS. 1, 2, and 3. In some embodiments, blades 14 are substantially identical. In some embodiments, one or more of the blades 14 are different than other blades 14. In some embodiments, blades 14 are removable, replaceable and/or interchangeable.

Figure 4A:
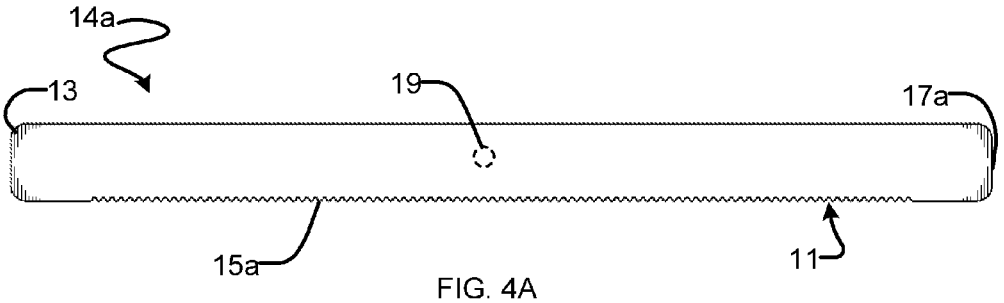
FIG. 4A is a plan view of an example blade for the example drywalling tool of FIG. 1A having a relatively rough leading edge.

For example, blade 14*a* may have a serrated, irregular, or otherwise non-smooth leading edge 15*a* suitable for shaving rough portions of drywall mud and/or to provide a relatively coarse smoothing. An example of such a blade 14*a* is shown in FIG. 4A. As is discussed in greater detail below, as tool 1 is drawn across a portion of drywall mud, blade 14*a* may be the first to pass across the portion of drywall mud, thereby shaving the portion of drywall mud down to a rough finish (e.g. relatively coarse smoothing action). Rough-edged blades such as blade 14*a* are generally more effective at shaving unfinished drywall mud than smooth-edged blades, as excess drywall mud is permitted to pass through channels 11, thereby permitting the leading edge 15*a* to penetrate more deeply into the drywall mud (and/or with relatively less force) than a smooth-edged blade. In some embodiments, blades 14 are arranged so that blade 14*a* leaves behind no more than 1 mm of excess drywall to be shaved by blade 14*b* (and/or other blades, such as blade 14*c*). Rough-edged blades such as blade 14*a* also tend to generate less fine particulate matter than sandpaper. Consequently, relative to smoothing drywall mud with sandpaper, the use of tool 1 to smooth drywall mud may result in the generation of less airborne particulate drywall mud.

Figure 4B:
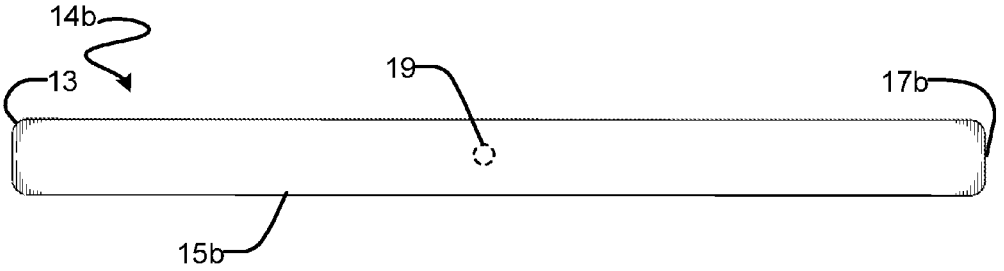
FIG. 4B is a plan view of an example blade for the example drywalling tool of FIG. 1A having a relatively smooth leading edge.

In some embodiments, blades 14*b* and 14*c* may have leading edges 15*b* and 15*c*, respectively, which may be relatively smooth in comparison to leading edge 15*a* of blade 14*a*. In some embodiments, blades 14*b* and 14*c* differ; for example, the leading edge 15*b* of blade 14*b* may be rougher than leading edge 15*c* and, optionally, smoother then leading edge 15*a*. In some embodiments, blades 14*b* and 14*c* are substantially identical (e.g. blade 14*c* may be substantially identical to blade 14*b* shown in FIG. 4B). Smooth-edged blades such as blades 14*b* and 14*c* may be used to provide a smooth finish to partially-finished drywall mud, such as drywall mud initially shaved by blade 14*a*. Providing multiple smooth-edged blades 14*b* and 14*c* be convenient in some circumstances, as multiple passes are sometimes desirable to effectively smooth a portion of drywall mud.

In some embodiments, corners 13 of blades 14 are rounded for safety, comfort, and/or to reduce the likelihood or severity of blades 14 digging into (and potentially damaging) drywall during use of tool 1. In some embodiments, blades 14 may be of different lengths (as measured between the leading edge and the opposing edge); for instance, blade 14*a* may have a shorter length than blade 14*b*, which may in turn have a shorter length in blade 14*c*, thereby allowing blades 14 to collectively provide an interface with drywall mud which is sloped relative to body 2. Alternatively, or in addition, blades 14 may be set at different locations in blade assembly 10 so that some blades 14 protrude further beyond body 2 than other blades 14.

In some embodiments, one or more of blades 14 may comprise an aperture 19 (shown in dashed lines) through which a rod, screw, or like member may pass to anchor blades 14 to connector 12. For example, connectors 12 may comprise apertures (not shown) corresponding to apertures 19 and a screw may pass through connectors 12 and blades 14 via the apertures in connectors 12 and blades 14. For example, the screw (not shown) may be anchored to connector 12*c* and pass through blades 14*a*, 14*b*, and 14*c* and connectors 12*a* and 12*b*.

In some embodiments, blade assembly 10 comprises one or more connectors 12 which connect (i.e. receive, are affixed to, hold in place, and/or otherwise house) blades 14 to blade assembly 10. Blade assembly 10 may, for example, comprise a single connector which runs along all or part of the width (as measured between transverse edge 17*a*, 17*b*, or 17*c* and the opposing transverse edge) of a blade 14. Blade assembly 10 may, for example, comprise a plurality of connectors which connect blades 14 in a plurality of locations, e.g. transversely spaced-apart locations as illustrated in FIGS. 1, 2, and 3 by connectors 12*a*, 12*b*, 12*c*, 12*d*, 12*e* (referred to collectively and individually herein as connectors 12).

Each connector 12 may connect one or more blades 14. For example, in an embodiment with blades 14*a*, 14*b*, and 14*c*, one or more connectors 12 may each connect each of blades 14*a*, 14*b*, and 14*c* (e.g. as shown in the embodiment of FIGS. 1, 2, and 3). Alternatively, or in addition, one or more connectors 12 may each connect a single blade 12 or a subset of the one or more blades 12. Connectors 12 may comprise any suitable material, such as rubber, plastic, foam, metal (e.g. aluminum), wood, and/or other materials.

Figure 7:
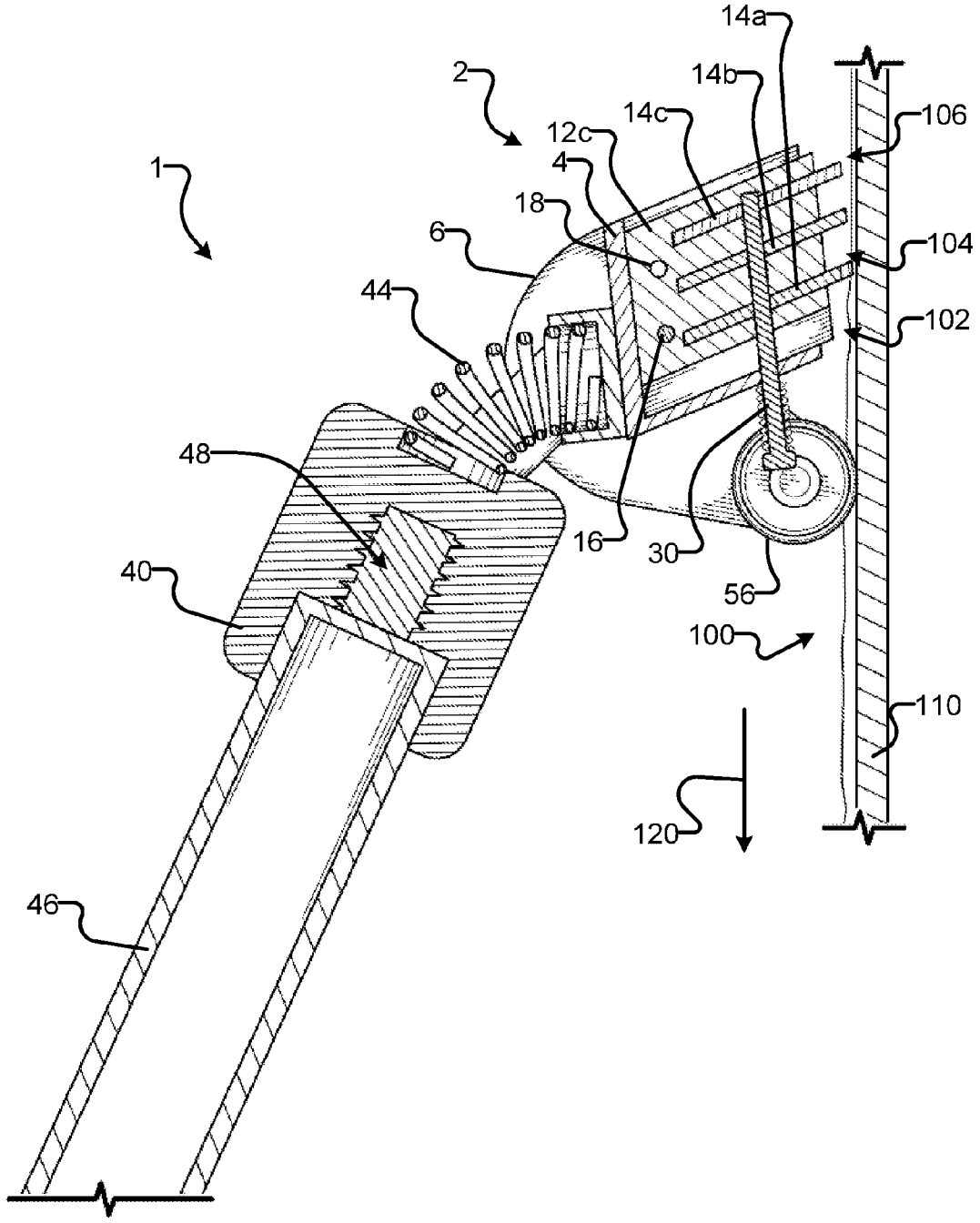
FIG. 7 is a side elevation cross-sectional view corresponding to FIG. 6, wherein the cross-section is taken through the displacement member.
Figure 8:
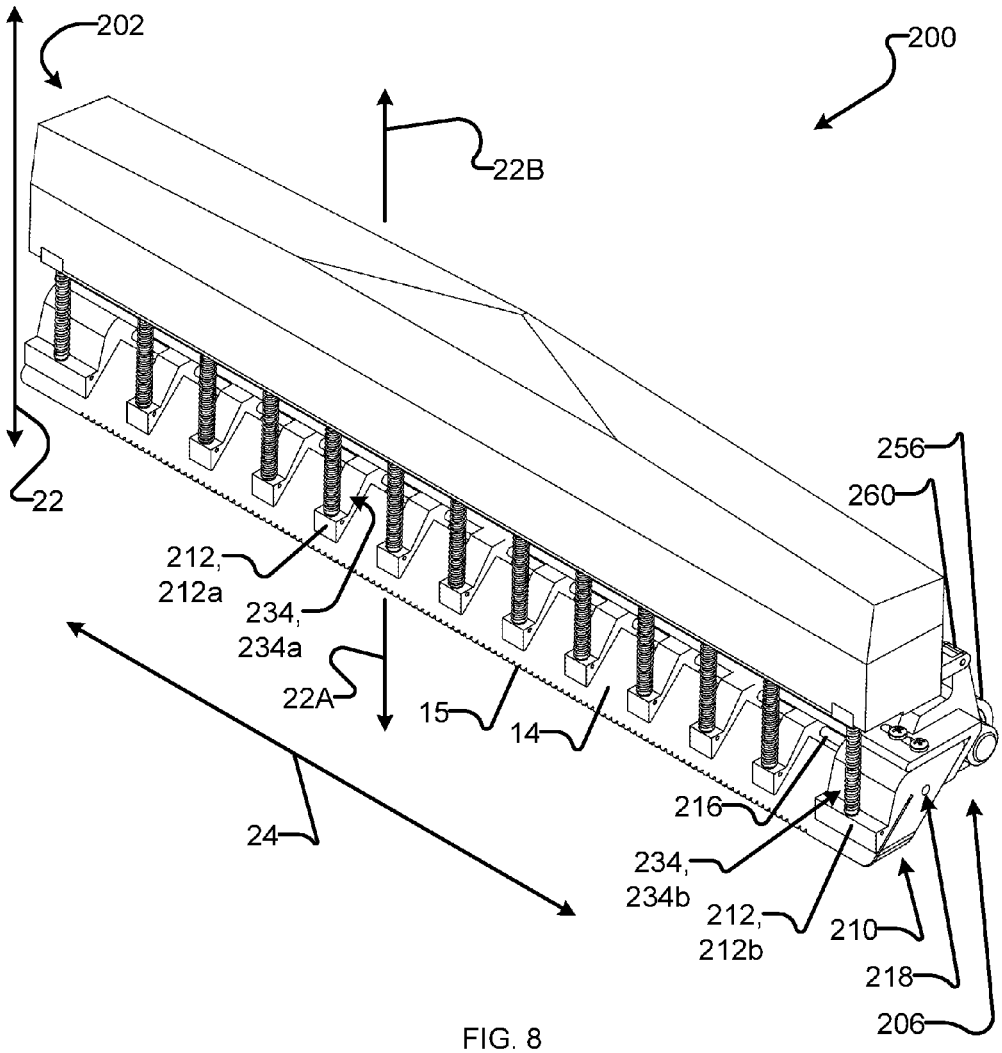
FIG. 8 is a perspective view of another example drywalling tool according to the present disclosure.

In embodiments with a plurality of connectors 12, connectors 12 may be connected to one another by one or more mounts 16. For example, mounts 16 may comprise a rod which passes through apertures 18 in connectors 12 (as shown in FIGS. 2A and 7), and/or may comprise a plurality of rods, each affixed to a connector 12 at one or more ends. As another example, mounts 16 may comprise all or a portion of body 2, in which case connectors 12 may each be connected to body 2 (e.g. as integrally-formed parts of body 2, or as separately-formed elements engaged with body 2). Mounts 16 may be any suitable shape or structure for connecting the connectors 12 of blade assembly 10 to each other.

Figure 5A:
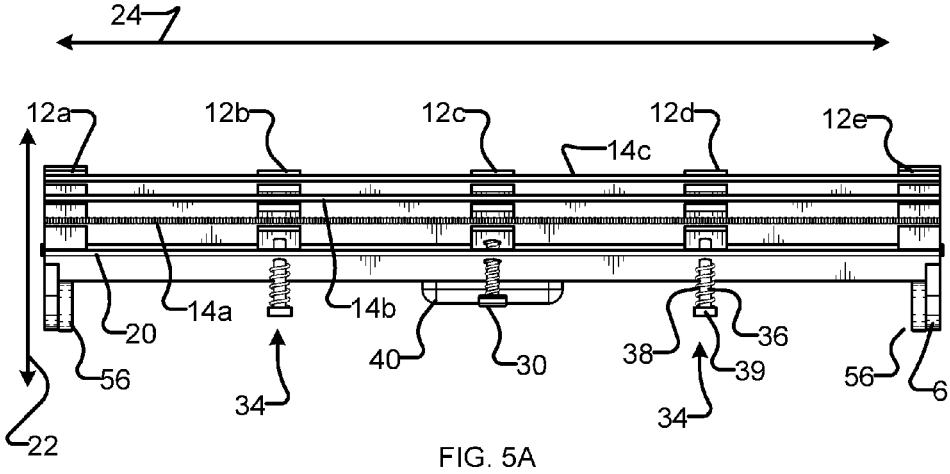
FIG. 5A is a front elevation view of the example drywalling tool of FIG. 1A while the blades of the tool are unflexed.
Figure 5B:
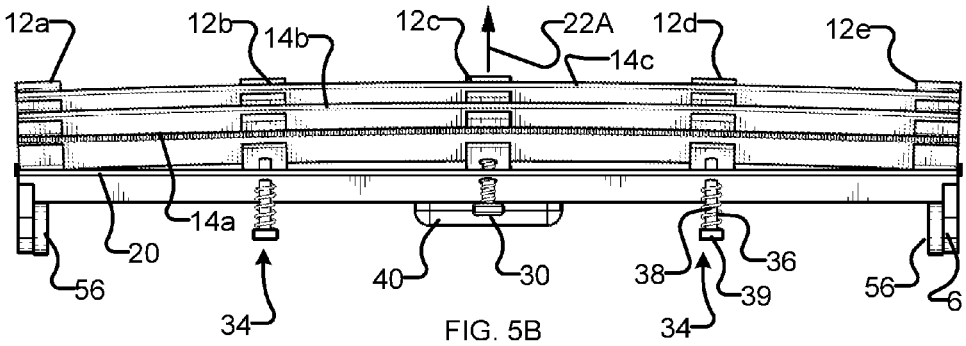
FIG. 5B is a front elevation view of the example drywalling tool of FIG. 1A while the blades of the tool are flexed in a first direction by a displacement member.
Figure 5C:
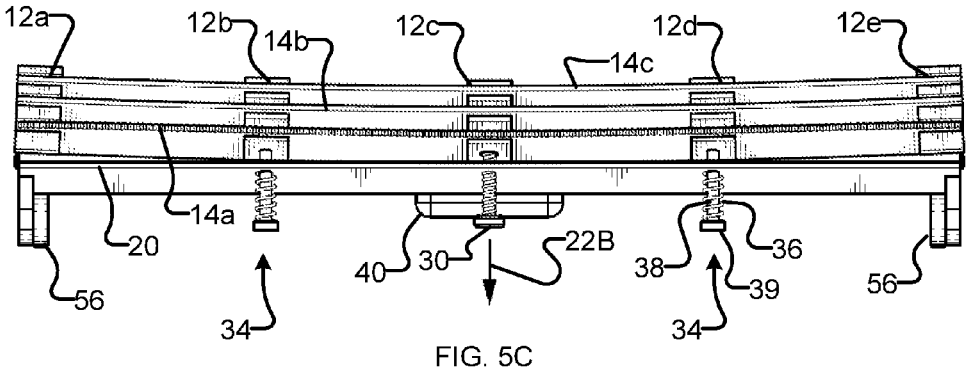
FIG. 5C is a front elevation view of the example drywalling tool of FIG. 1A while the blades of the tool are flexed in a second direction by biasing mechanisms.

In some embodiments, blades 14 are flexible. Blade assembly 10 may also be flexible and may hold blades 14 to permit flexion of blades 14. For example, as shown in FIG. 5A, blades 14 may extend in transverse directions 24 and flex in flexion directions 22. Blade assembly 10 may provide a plurality of connectors 12 spaced apart in transverse directions 24 and permitting certain connectors 12 (e.g. 12*c*) to move in flexion directions 22 while other connectors 12 (e.g. 12*a*, 12*e*) do not move in flexion directions 22, move relatively less in flexion directions 22, and/or move in a direction 22 opposing the movement of the certain connectors 12. FIG. 5B shows an example scenario wherein blades 12 are deformed in flexion direction 22A away from a support 20 and FIG. 5C an example scenario wherein blades 14 are flexed such that at least central portions of blades 14 are deformed in flexion direction 22B toward support 20. FIGS. 5A, 5B, and 5C are collectively and individually referred to herein as FIG. 5.

In some embodiments having a plurality of connectors 12, mounts 16 may be flexible in at least flexion directions 22. For example, mounts 16 may comprise one or more flexible rods connecting connectors 12. Thus, flexion of blades 14 may be accompanied by a corresponding displacement of connectors 12 which is matched by flexion in mounts 16. Mounts 16 may be flexible between two points spaced apart in the transverse directions 24 and substantially fixed in flexion directions 22 at those points. For example, mounts 16 may connect to connectors 12*a* and 12*e*, each of which may be attached to body 2 and substantially fixed in flexion directions 22 (as discussed in greater detail below). In embodiments with flexible mounts 16, mounts 16 may be made of any suitable material, such as flexible plastic, wood, metal, cord, and/or other materials, including non-flexible materials arranged in a flexible structure (e.g. linked chains or the like).

In some embodiments, tool 1 comprises an adjustment mechanism 30 for flexing one or more blades 14. In the embodiment illustrated in FIG. 5, adjustment mechanism 30 comprises displacement member 30. Displacement member 30 is moveable in directions 22 relative to support 20. Movement of displacement member 30 relative to support 20 may thus change the force experienced by one or more blades 14, and many correspondingly change the corresponding reaction force experienced by support 20. Blades 14 may be relatively more deformable than support 20, and so blades 14 may deform away from support 20 (i.e. in direction 22A) and/or toward support 20 (i.e. in direction 22B). In this sense, support 20 may be considered to be an anchor, and movement of displacement member 30 relative to support 20 may increase and/or decrease flexion of one or more blades 14 in direction 22.

FIG. 5B shows an example scenario where displacement member 30 has been moved in direction 22A and is pressed against connector 12*c*, thereby pushing connector 12*c* away from support 20 and flexing at least a central portion of blades 14 (along with mounts 16 and connectors 12*b*, 12*c*, and 12*d*) away from support 20. Displacement member 30 may be selectively moved to flex blades 14 and/or blade assembly 10 to a greater or lesser degree (e.g. by advancing or retracting displacement member 30).

In some embodiments, a plurality of adjustment mechanisms 30 (e.g. displacement members 30) are provided, thereby providing a user with more options in the flexion of blades 14. For example, displacement members 30 may be positioned at suitable locations to apply force in directions 22 to connectors 12*a*, 12*c*, and 12*e* (and/or at other locations, including at other connectors 12 and other transverse locations relative to blades 14), allowing a user to provide different curvatures to different portions of blades 14. In some such embodiments, connectors 12*a* and 12*e* are permitted to move and/or deform in flexion directions 22 to accommodate the plurality of displacement members 30.

In the illustrated embodiment, displacement member 30 and support 20 are threaded to facilitate the movement of displacement member 30 relative to support 20 in directions 22 by suitable threaded rotation of displacement member 30. For example, displacement member 30 may be threadably engaged with support 20 via a threaded aperture 32 in support 20. For example, displacement member 30 may comprise a threaded screw with a head operable to be engaged by a screwdriver, a user's fingers, or other means for driving a displacement member 30.

Adjustment mechanism 30 (e.g. displacement member 30) may comprise any suitable means for flexing one or more blades 14 and/or blade assembly 10 in directions 22 relative to support 20. For example, adjustment mechanism 30 may comprise a telescoping rod, piezoelectric stack, ratcheted jack, and/or any other adjustable mechanism for displacing a portion of (and thereby flexing) one or more blades 14.

In some embodiments, tool 1 comprises a biasing mechanism 34 for flexing blades 14. Biasing mechanism 34 biases one or more blades 14 in flexion direction 22. For example, biasing mechanism 34 may bias one or more blades 14 in direction 22B towards support 20, so that (absent a countervailing force from adjustment mechanism 30) one or more blades 14 flex in direction 22B towards support 20. Thus, biasing mechanism 34 and adjustment mechanism 30 may cooperate to permit flexion both toward and away from support 20 (i.e. in directions 22A, 22B), according to the operation of adjustment mechanism 30. For example, biasing mechanism 34 may flex one or more blades 14 towards displacement member 30 so that retracting displacement member 30 (e.g. moving displacement member 30 in direction 22B) permits further flexion by biasing mechanism 34 in direction 22B towards support 20. Displacement member 30 may overcome the biasing force of biasing mechanism 34 by moving in direction 22A.

An example of a biasing mechanism 34 is shown in FIG. 5. In the embodiment shown in FIG. 5, biasing mechanism 34 comprises a rod 38 passing through support 20 and connecting at an end to a connector 12 (and in particular, in this example, to one of connectors 12*b* and 12*d*). Biasing mechanism 34 has a head 39 at an opposing end. A spring 36 is provided around rod 38 and bears on support 20 and head 39 to bias head 39 away from support 20 in direction 22B. Head 39 has a circumference greater than spring 36, and may comprise a disk, ball, cross, or other suitable shape for retaining spring 36. When head 39 is biased in direction 22B away from support 20, rod 38 connected to connector 12 pulls connector 12 and a corresponding portion of blade 14 in direction 22B toward support 20. In this manner, biasing mechanism 34 acts to bias corresponding portions of one or more blades 14 (and/or blade assembly 10) in direction 22B towards support 20.

In the depicted embodiment, two biasing mechanisms 34 are provided, connecting to connectors 12*b* and 12*d* at corresponding transversely spaced apart locations and corresponding transversely spaced apart portions of blades 14 and/or blade assembly 10. In the illustrated embodiment, each of these locations is located transversely outwardly from the location of adjustment mechanism 30. In some embodiments, a greater or lesser number of biasing mechanisms 34 are provided, and/or biasing mechanisms 34 may be provided in different locations. For example, a biasing mechanism 34 may be provided at the same location in transverse directions 24 as adjustment mechanism 30 (e.g. appearing to be behind or in front of adjustment mechanism 30 in the FIG. 5 view) and connect to connector 12*c*.

Biasing mechanism(s) 34 may also, or alternatively, be provided on an opposing side of blade assembly 10. For example, a biasing mechanism 34 may be provided at a side of connector 12*c* opposing adjustment mechanism 30 and thus bias connector 12*c* in direction 22B towards adjustment mechanism 30 and/or support 20. Such a biasing mechanism 34 may, for example, comprise a spring mounted to body 2 and/or to a second support (not shown) parallel to support 20. Such biasing mechanisms 34 may alternatively, or additionally, be provided at other locations, such as at the locations of connectors 12*b*, 12*d* and/or other locations on blades 14 directly.

Biasing mechanism 34 may comprise any suitable means for flexing blades 14 and/or blade assembly 10 (and/or a corresponding portion thereof) in direction 22B towards support 20 by biasing all or part of blade assembly 10 and/or blades 14. For example, biasing mechanism 34 may comprise a spring, an elastic connector between blade assembly 10 and support 20, and/or any other mechanism for biasing and thereby flexing blade assembly 10 and/or blades 14 and/or corresponding portions thereof.

In some embodiments, adjustment mechanism 30 is operable to flex blades 14 (and/or a corresponding portion thereof) in direction 22B towards support 20 without, or in addition to, the biasing action of biasing mechanism 34. For example, adjustment mechanism 30 may be affixed to connector 12*c* so that, as adjustment mechanism 30 is retracted in direction 22B towards support 20, connector 12*c* is drawn in direction 22B towards support 20, thereby causing a corresponding flexion in blades 14 (and/or a corresponding portion thereof) in direction 22B towards support 20. In other embodiments, displacement member is not affixed to connector 12*c*, e.g. to allow blades 14 to flex further in direction 22A during use of tool 1.

As blades 14 flex in direction 22, the total dimension of blades 14 in transverse directions 24 will variously expand and contract. In some embodiments, connectors 12*a* and 12*e* move in transverse directions 24 so as to be positioned closer together as the flexion of blades 14 increases and further apart as the flexion of blades 14 decreases. For example, connectors 12*a* and 12*e* may be movably mounted to body 2 so that connectors 12*a* and 12*e* may move in transverse directions 24 as blades 14 flex, while (optionally) keeping connectors 12*a* and 12*e* substantially fixed in the flexion direction 22. In some embodiments, one or more connectors 12 may be deformable, and in particular may be deformed in a manner corresponding to the deformation of one or more blades 14.

For example, as shown in FIG. 1C, one or both of connectors 12*a* and 12*e* may comprise a protrusion 52 which is received in a corresponding aperture or recess of body 2, such as aperture 50. Aperture 50 may be elongated in transverse directions 24 and have a width in flexion directions 22 substantially corresponding to a width of protrusion 52. Thus, protrusion 52 may slide transversely into or out of aperture 50 in transverse directions 24 while remaining substantially fixed in flexion directions 22.

Body 2, blade assembly 10, blades 14 and various other elements described above may be used in a variety of drywall mud-smoothing tools, ranging from small handheld tools to large industrial or machine-mounted tools. The present disclosure presents an exemplary handheld tool 1, described in greater detail below, but it will be understood that the present disclosure is not limited to the illustrated tool 1.

FIGS. 1-3 and 5-7 depict a tool 1 having a body 2 connected to a handle assembly 40. Handle assembly 40 receives and/or comprises a handle 46 (an example of which is shown in FIG. 1) to be held by a user during use of tool 1. In the depicted embodiment, handle assembly 40 comprises a body defining an aperture 48. Aperture 48 may, for example, be threaded and suitable for receiving a threaded end of handle 46. In some embodiments, handle 46 and handle assembly 40 are integrally formed, so that handle assembly 40 is shaped to be held by a user's hand. In some embodiments, handle assembly 40 is operable as a handle (e.g. handle assembly 40 may be shaped to be held by a user's hand) and also provides an aperture 48 for receiving a handle 46; thus, for example, handle assembly 40 may be used as a handle when a longer handle is not needed, and a longer handle 46 (e.g. a pole) may be used when needed or desired.

Handle assembly 40 may connect to body 2 via one or more support arms 42. For example, support arms 42 may extend from handle assembly 40 to frame 6 (see FIG. 1). Support arms 42 may connect to body 2 at one or more transverse locations on body 2 and/or continuously across a transverse dimension of body 2 to distribute force applied at handle 46 across body 2, thereby allowing force applied to handle assembly 40 to distribute transversely across blades 14. In the embodiment depicted in FIG. 1, two support arms 42 are provided which connect with body 2 at a plurality of transversely spaced-apart locations. In some embodiments, one or more wedge-shaped support arms 42 are provided, each support arm widening from a narrow transverse width at handle assembly 40 to a wider transverse width at body 2, thereby distributing force across body 2.

In some embodiments, handle assembly 40 is pivotably connected to body 2. For the sake of convenience, body 2 will be referred to as being pivotable relative to handle assembly 40, although it will be understood that handle assembly 40 can be equivalently understood to pivotable relative to body 2. Body 2 may pivot in any of several directions. For example, body 2 may pivot about a transverse axis parallel to transverse directions 24 (e.g. so that, as body 2 pivots, leading edges of blades 14 move in roughly flexion direction 22). FIGS. 1-3 depict an example embodiment with this type of pivoting, as discussed further below. Body 2 may also, or alternatively, pivot about an axis parallel to flexion direction 22. For example, handle assembly 40 may connect to body 2 via a swivel joint, about which body 2 may pivot.

In the example embodiment of FIGS. 1-3, support arms 42 comprise transversely-oriented axles 60 (i.e. axles oriented parallel to directions 24) received by apertures 62 in body 2. Body 2 may be pivotable about axles 60, and in particular may be pivotable about an axis 64 extending substantially in transverse directions 24 between axles 60.

A biasing mechanism 44 may be provided between handle assembly 40 and body 2 to bias body 2 towards a particular position relative to handle assembly 40 (e.g. away from handle assembly 40). Providing such a bias may help maintain a suitable angle between blades 14 and drywall mud during use of tool 1 while still permitting some flexibility in the position of body 2 relative to handle 46, which may be desirable in certain circumstances. For example, if tool 1 is being drawn across a particularly uneven portion of drywall mud, biasing mechanism 44 may, in some circumstances, assist in enabling blades 14 to travel in a less-uneven path than would be followed if body 2 were rigidly attached to handle assembly 40.

Biasing mechanism 44 may bias body 2 so that the angle θ at which blades 14 extend relative to handle assembly 40 and/or handle 46 (see, e.g., FIG. 3) is kept within a range under typical usage conditions and/or at rest. In some embodiments, biasing mechanism 44 may bias body 2 to maintain angle θ in the range of 20° to 60°. For example, biasing mechanism 44 may bias body 2 towards a position where angle θ is 22.5°. Referring to FIG. 7, such an angle may enable guides 56 to make contact with drywall 110 while still permitting a separation between drywall 110 and blades 14. It will be understood that, in some embodiments, certain exertions of force and/or extreme conditions may cause angle θ to leave the range promoted by biasing mechanism 44 temporarily.

Biasing mechanism 44 may comprise any suitable means for biasing body 2 towards a particular position or range of positions relative to handle assembly 40. For example, biasing mechanism 44 may comprise a spring, a resilient connector between handle assembly 40 and body 2, and/or any other mechanism for biasing body 2 relative to handle assembly 40.

In some embodiments, tool 1 provides a guide 56 for guiding body 2 along drywall during use. Guide 56 may assist in maintaining registration between leading edges 15 and a portion of drywall mud during use of tool 1, may space body 2 away from the drywall and/or drywall mud during use of tool 1, and/or may assist the user in smoothly moving body 2 along the drywall and/or drywall mud. Tool 1 may comprise any number of guides 56, but in some embodiments tool 1 comprises at least two guides 56—a first guide 56 proximate to one transverse side of body 2 and a second guide 56 proximate to an opposing transverse side of guide 56. The guides 56 may be spaced apart sufficiently in transverse directions 24 (e.g. 15 cm to 60 inches, or 6 inches to 24 inches, in various embodiments) to allow a typical expanse of drywall mud to fit between them; in such embodiments, guides 56 may be adapted to smoothly slide, roll, or otherwise move along drywall while blades 14 smooth the drywall mud applied to the drywall between the guides 56.

In some embodiments, the position of guide 56 is adjustable in protrusion directions 26 (shown in FIG. 3) relative to body 2 and/or blades 14. A user may adjust such guides 56 to protrude past leading edges 15 in protrusion direction 26, retract behind leading edges 15 of blades 14 in protrusion direction 26, and/or remain flush with leading edges 15 in protrusion direction 26. Different degrees of adjustment may be desirable depending, for example, on the depth that the user desires blades 14 to shave drywall mud. Retraction of guide 56 may cause body 2 to be positioned closer to the drywall, thereby assisting blades 14 in penetrating deeper (and thereby shaving deeper) into the drywall mud during use.

In one non-limiting example embodiment, guide 56 may comprise a wheel mounted to frame 6. Guide 56 may protrude beyond body 2 in protrusion direction 26B so that, when leading edges 15 are each positioned against a portion of drywall mud (such as drywall mud 100 applied to drywall 110 in FIG. 6), guide 56 is suitably positioned to support body 2 against the drywall and/or drywall mud. An example of such an arrangement is shown in FIG. 6.

Guide 56 may comprise a wheel, a flat surface (e.g. defined by body 2) for sliding along a portion of drywall, and/or any other suitable structure which assists with maintaining registration between leading edges 15 and drywall mud during use of tool 1.

In some embodiments, the position of one or more blades 14 is adjustable in protrusion directions 26. For example, one or more adjustment mechanisms (such as displacement member 30) may be anchored to body 2 and extend towards blade assembly 10 in protrusion direction 26B. Moving these adjustment mechanisms (not shown) in protrusion direction 26B may cause blades 14 to protrude further beyond guide 56, thereby allowing relatively deeper shaving of drywall mud, substantially as discussed above. Moving these adjustment mechanisms (not shown) in protrusion direction 26A may cause blades 14 to protrude less far beyond guide 56, and/or even retract behind guide 56 in protrusion direction 26A, thereby allowing relatively shallower shaving of drywall mud. In some embodiments, one or more blades 14 are selectively adjustable in protrusion directions 26 independently of one or more other blades 14; for example, rough-edged blade 14*a* may be advanced so that leading edge 15*a* protrudes beyond leading edges 15*b* and/or 15*c* in protrusion direction 26B.

Figure 6:
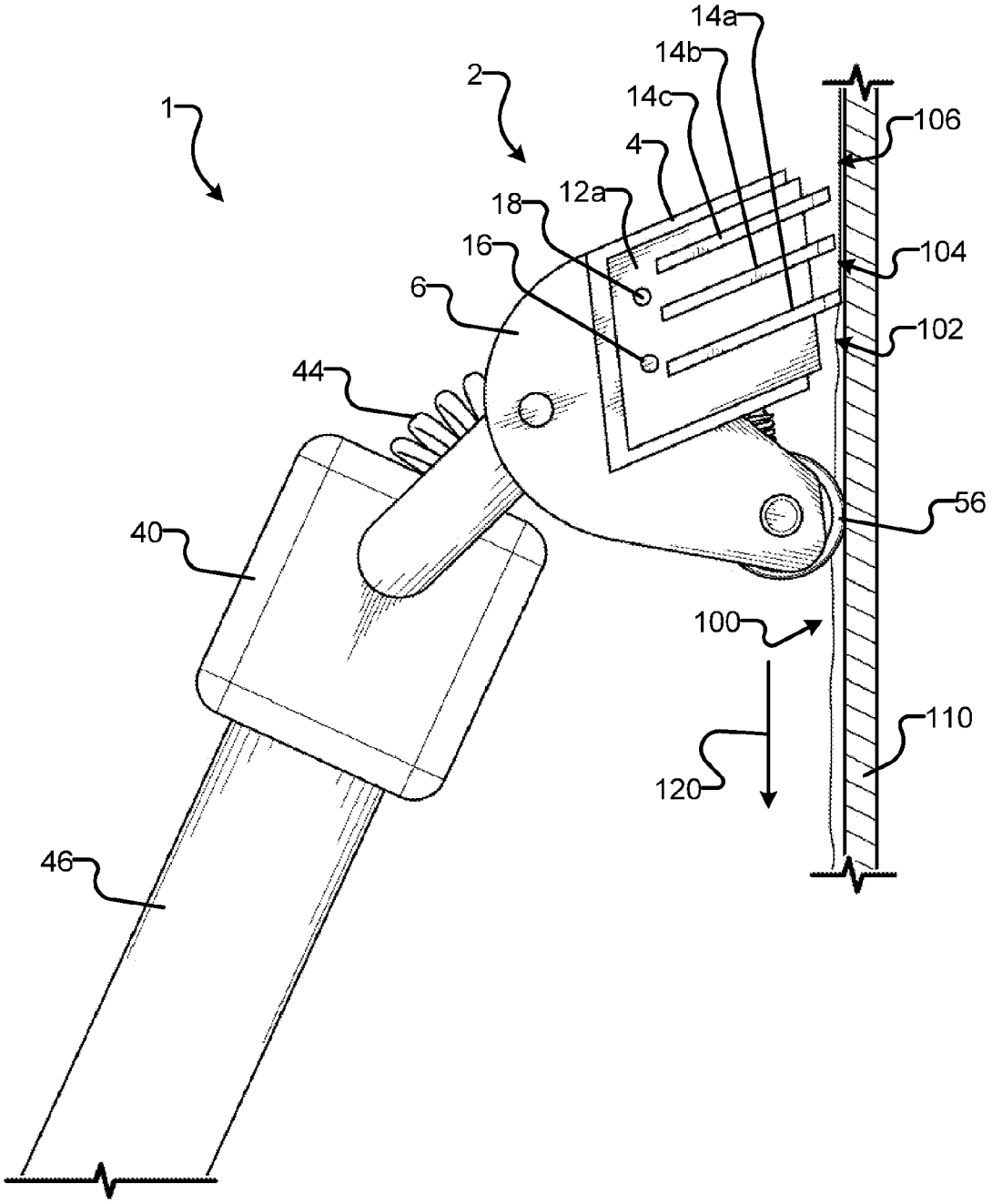
FIG. 6 is a side elevation view of the example drywalling tool of FIG. 1A while being used to smooth dried drywall mud.

FIGS. 6 and 7 illustrate a method for smoothing dried drywall mud according to the present disclosure. Tool 1 may be positioned against drywall 110 so that the one or more blades 14 abut drywall mud 100. Tool 1 may then be advanced along drywall 110 in advancement direction 120 (e.g. by a user applying force to handle 46). The user applies force to handle 46, which causes blades 14 to pass across a portion of drywall mud 100 with sufficient force to at least partially smooth drywall mud 100. Each successive pass of a blade 14 across a portion of drywall mud 100 may further smooth the portion of drywall mud 100.

In embodiments with multiple blades 14, this process may be expedited. For example, a rough-edged blade 14*a* may advance along an unfinished drywall mud portion 102, thereby shaving excess drywall mud and transforming unfinished drywall mud portion 102 into rough drywall mud portion 104. Rough-edged blade 14*a* may comprise one or more channels 11 through which excess drywall mud may pass as unfinished drywall mud portion 102 is shaved. As tool 1 is drawn across drywall 110, smooth-edged blade 14*b* may be subsequently drawn across rough drywall mud portion 104, thereby further smoothing portion 104. Additional blades, such as smooth-edged blade 14*c*, maybe be subsequently drawn across rough drywall mud portion 104, thereby smoothing portion 104 even further. Such smoothing may transform rough drywall mud portion 104 to a relatively smoothed drywall mud portion 106. Thus, a plurality of adjacent unfinished drywall mud portions 102 may be smoothed into relatively smoothed drywall mud portions 106 by simultaneously advancing the several blades 14 along portions of drywall mud 100.

In some embodiments, blades 14 may be flexed to permit the smoothed portion 106 to possess some curvature. For example, when smoothing drywall mud on top of a tape seam, the corner, counter-sunk screw, and/or the like, it may be desirable for the drywall mud to have increased thickness in that location (while still appearing smooth) to conceal the underlying feature, whereas it may be desirable for drywall mud away from the feature to be concealed to have decreased thickness to blend with the surrounding drywall 100. In some circumstances, this may be accomplished by flexing blades 14 in the appropriate direction prior to smoothing drywall mud 100. As another example, it may be desirable to provide a particular curvature to drywall mud 100 when smoothing a curved portion of drywall 110.

As discussed above, flexion may be accomplished by adjusting adjustment mechanism 30 (e.g. displacement member 30) to press against blade assembly 10 and/or blades 14, thereby selectively flexing corresponding portions of blades 14. Alternatively, or in addition, blades 14 may be flexed by a biasing mechanism 34 (optionally mediated to a countervailing force exerted by an adjustment mechanism 30). Once flexed, the one or more blades 14 may be positioned against a portion of drywall mud 100 and advanced along the drywall mud to engage in a smoothing action substantially as described above.

FIGS. 8-10, 11A and 11B (collectively and individually "FIG. 11"), and 12A and 12B (collectively and individually "FIG. 12") show another example drywalling tool 200. Throughout FIGS. 8-12, like reference numerals refer to like features of FIGS. 1-7; for example, blade assembly 210 corresponds generally to blade assembly 10, although like-numbered features may comprise various differences as described in greater detail herein. For convenience, drywall tool 200 is generally described with reference to the same directions 22, 24, 26 as were provided in FIGS. 1-7.

Drywall tool 200 comprises a body 202 coupled to a frame 206. Body 202 may be shaped to be held by a user (and thus may function as a handle). A blade assembly 210 is coupled to frame 206 and retains one or more blades 14 having leading edges 15. Blade assembly 210 comprises one or more connectors 212 for retaining blades 14 and, in some embodiments, one or more biasing mechanisms 234 for flexing blades 14. In the depicted embodiment, blade assembly 210 retains one blade 14, although it will be appreciated that blade assembly 210 may retain a plurality of blades 14 (e.g. as described above).

Biasing mechanisms 234 bias one or more blades 14 in flexion direction 22. In some embodiments (including the depicted embodiment of FIGS. 8-12), biasing mechanisms 234 bias blade 14 in flexion direction 22A toward body 202. In some embodiments, biasing mechanisms 234 do not flex blade 14 when at rest; that is, when blade 14 is substantially unflexed (and is not being flexed in flexion direction 22B by a countervailing force), biasing mechanisms 234 do not exert any significant force on blade 14 in direction 22A.

In some embodiments (including the depicted embodiment of FIGS. 8-12), adjustment mechanism 30 is omitted, and biasing mechanisms 234 provide tension which partially counteracts flexion of blade 14 in flexion direction 22B caused by (for example) drywall mud being smoothed by blade 14. By maintaining such tension, biasing mechanisms 234 may enable blade 14 to more effectively smooth drywall mud (relative to an unbiased blade which flexes away from such drywall mud more easily) while still providing some flexibility of blade 14 in flexion directions 22.

Figure 9:
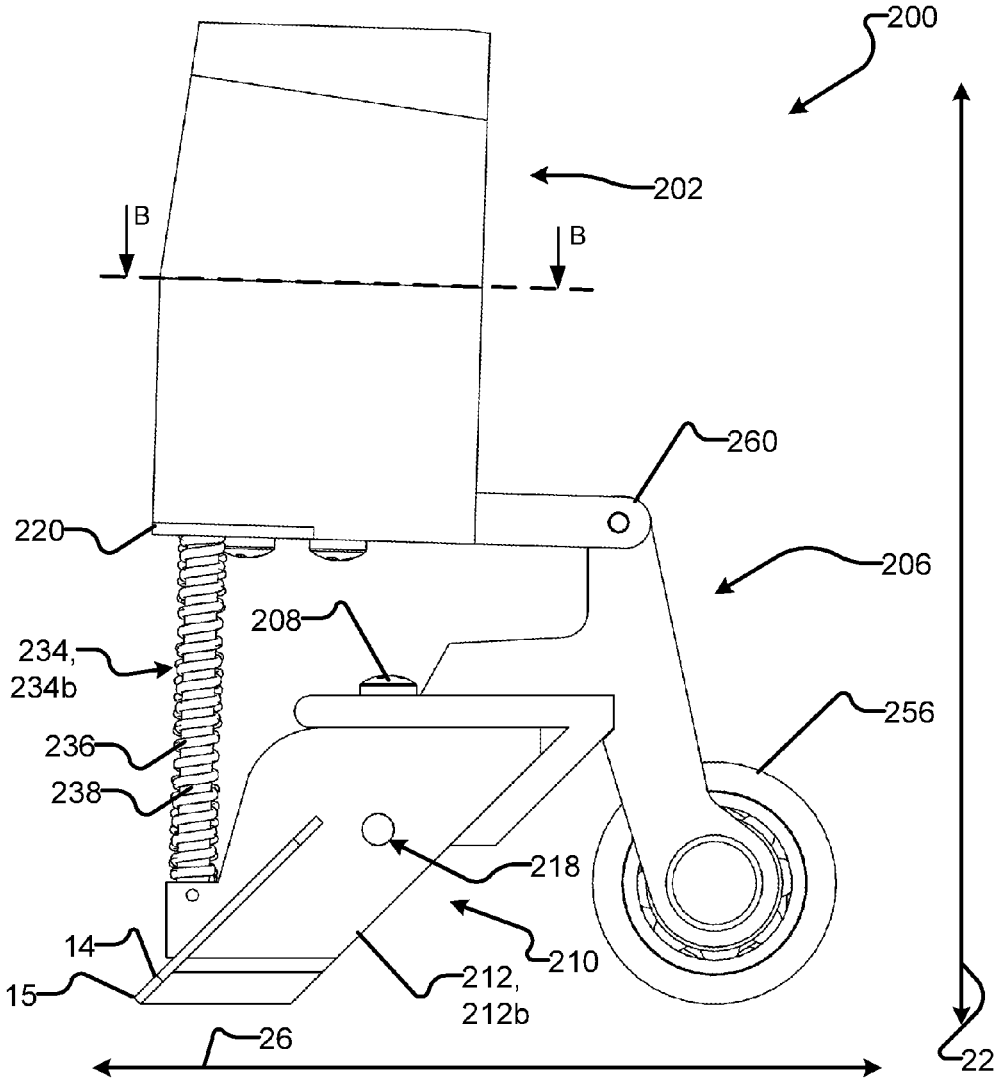
FIG. 9 is a side elevation view of the example drywalling tool of FIG. 8.
Figure 10:
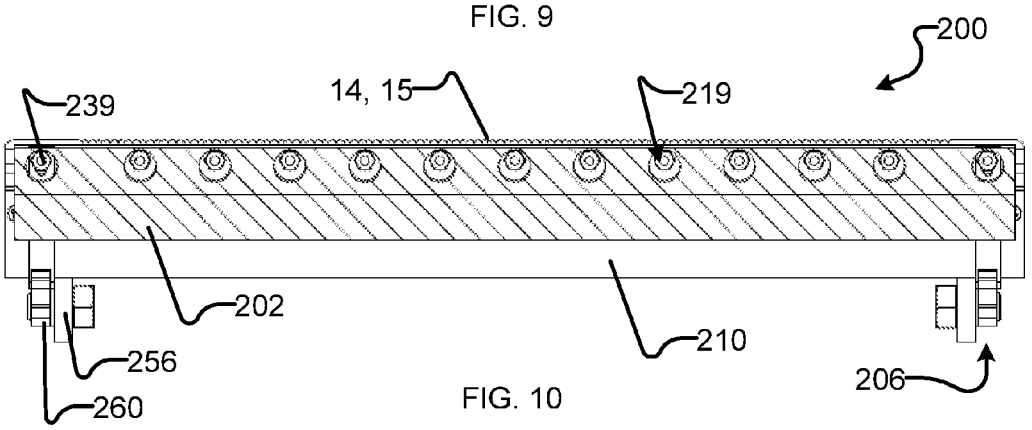
FIG. 10 is a cross-sectional view of the example drywalling tool of FIG. 8 taken along line B-B of FIG. 9.

Biasing mechanisms 234 may be of any suitable construction, as described above. In some embodiments, biasing mechanisms 234 comprise rods 238, springs 236, and (optionally) heads 239. Such biasing mechanisms 234 are best shown in FIGS. 9 and 10. FIG. 9 is a side elevation view of drywalling tool 200, and FIG. 10 is a cross-sectional view of drywalling tool 200 taken along line B-B of FIG. 9. In some embodiments, rods 238 connect to blade assembly 210 (e.g. to connectors 212) and heads 239 are retained in cavities 219 of body 202. Springs 236 may be retained between connectors 212 and an internal surface of cavity 219, thereby biasing body 202 and connectors 212 against each other. Springs 236 may be further retained by rods 238.

In some embodiments, head 239 abuts an internal surface of cavity 219 when body 202 is moved close to connectors 212, thereby preventing body 202 from moving nearer to connectors 212. In some embodiments, head 239 is retained in cavity 219 so that, when body 202 is moved away from connectors 212, head 239 prevent at least a portion of body 202 from moving beyond head 239, thereby preventing body 202 from moving further away from connectors 212. For example, head 239 may abut against a support 220 of body 202. Head 239 does not necessarily retain spring 239 in such embodiments, as that function may be provided by body 202 and/or other elements of drywalling tool 200.

In the depicted embodiment, thirteen biasing mechanisms 234 are provided, connecting to a corresponding number of connectors 212. Any suitable number of biasing mechanisms 234 may be provided. In some embodiments, a sufficient number of biasing mechanisms 234 are provided so that each biasing mechanism 234 is spaced apart from adjacent biasing mechanisms 234 by at most 2.5 cm (approximately 1 inch). In some embodiments, some biasing mechanisms 234 provide less biasing force than other biasing mechanisms 234. For example (and as shown in the depicted embodiment), transversely outermost biasing mechanisms 234*b* provide greater biasing force (e.g. by providing springs 236 with a greater spring constant) than transversely inward biasing mechanisms 234*a*.

Transversely inward biasing mechanisms 234*a* may connect to transversely inward connectors 212*a* and transversely outermost biasing mechanisms 234*b* may connect to transversely outermost connectors 212*b*. In some embodiments, transversely outermost biasing mechanisms 234*b* retain blade 14 relatively more securely than transversely inward biasing mechanisms 234*a*. For example, transversely outermost biasing mechanisms 234*b* may prevent the portions of blade 14 which they retain from bending (e.g. to prevent the edges of blade 14 from gouging drywall during use). In some embodiments, transversely outermost biasing mechanisms 234*b* are fixedly attached to frame 206 (e.g. by fasteners 208). In some embodiments, transversely outermost biasing mechanisms 234*b* are longer in transverse directions 24 than transversely inward biasing mechanisms 234*a*.

In some embodiments, connectors 212 may be connected to one another by one or more mounts 216. For example, mounts 216 may comprise a rod which passes through apertures 218 in connectors 212, and/or may comprise a plurality of rods, each affixed to a connector 212 at one or more ends. Alternatively, or in addition, mounts 216 may be otherwise constructed, as described above. Mounts 216 may be any suitable shape or structure for connecting the connectors 12 of blade assembly 10 to each other.

In some embodiments, body 202 is pivotably connected to frame 206. For example (as shown in the depicted embodiment), body 202 may be connected to frame 206 by a hinge 260. Body 202 may pivot about hinge 260. Biasing mechanisms 234 may bias such pivoting movement so that pivoting toward connectors 212 is typically opposed and pivoting away from connectors 212 is amplified by biasing mechanisms 234 (although it will be understood that, if body 202 is pulled away from connectors 212 beyond a neutral position of biasing mechanisms 234, this opposition/amplification relationship may be reversed). Such opposition and/or amplification may be overcome by the application of force against body 202 by a user.

In some embodiments, drywalling tool 200 provides a guide 256. As described above with reference to guide 56, guide may comprise a wheel mounted to frame 206, a flat surface (e.g. defined by frame 206, body 202, and/or blade assembly 210) for sliding along a portion of drywall, and/or any other suitable structure which assists with maintaining registration between leading edges 15 and drywall mud during use of tool 200. In at least the depicted embodiment, an outermost edge of guide 256 is substantially parallel with leading edge 15 in flexion direction 22.

Figure 11A:
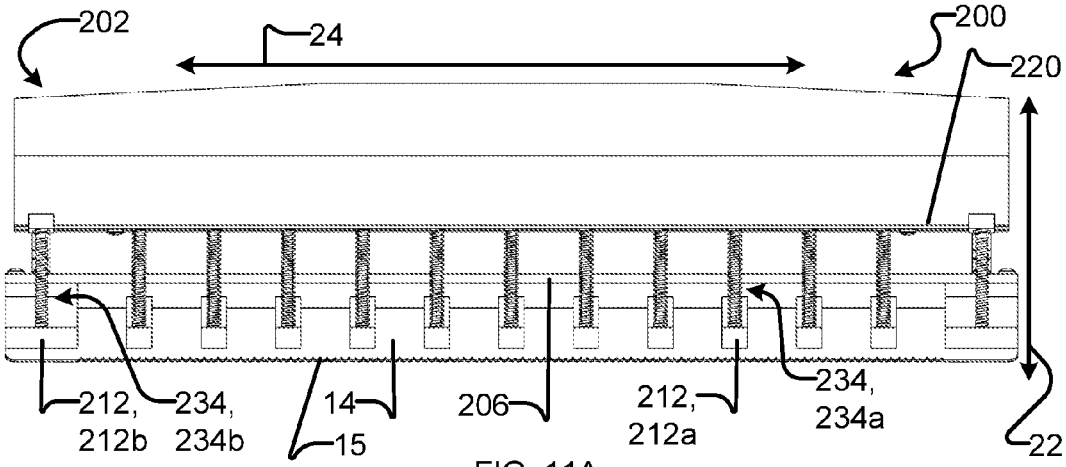
FIG. 11A is a front elevation view of the example drywalling tool of FIG. 8.
Figure 11B:
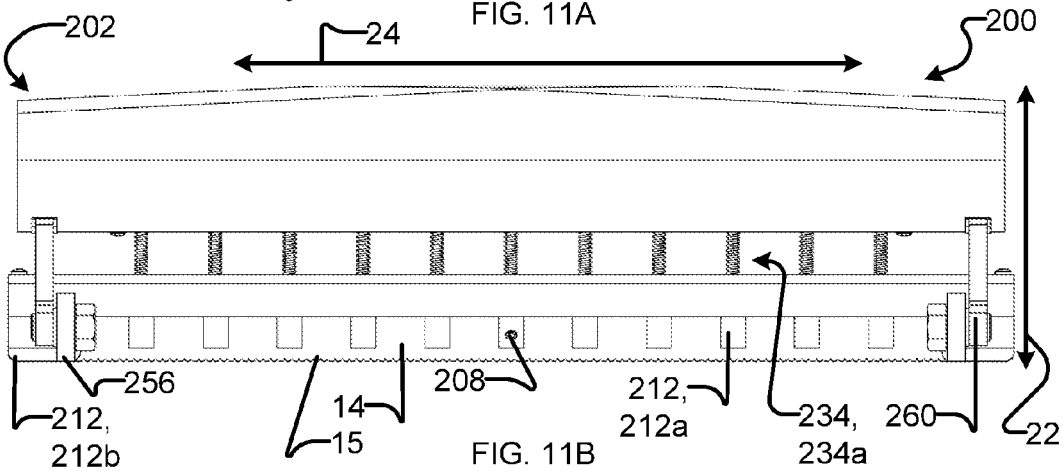
FIG. 11B is a back elevation view of the example drywalling tool of FIG. 8.
Figure 12A:
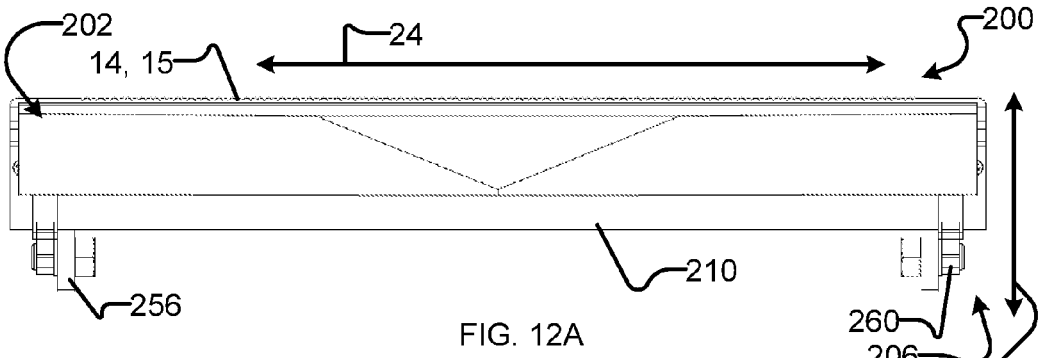
FIG. 12A is a plan view of the example drywalling tool of FIG. 8.
Figure 12B:
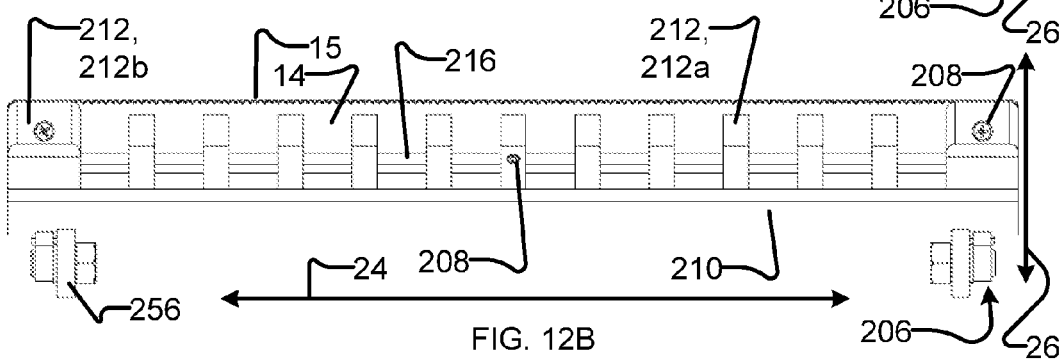
FIG. 12B is a plan view of the example drywalling tool of FIG. 8, showing an opposing side relative to the view of FIG. 12A.

FIGS. 11 and 12 show additional views of drywalling tool 200, for greater clarity. FIG. 11A shows a front elevation view of drywalling tool 200, whereas FIG. 11B shows a back elevation view (i.e. from an opposing side to the view of FIG. 11A) of drywalling tool 200. FIGS. 12A and 12B show plan views of opposing sides of drywalling tool 200; for convenience, FIG. 12A may be considered to provide a "top" view, and FIG. 12B may be considered to provide a "bottom" view (although, as described below, "top" and "bottom" do not limit the orientations of drywalling tool 200).

As shown (for example) in FIGS. 11B and 12B, in some embodiments one or more connectors 212 may be fastened to blade 14 by fasteners 208. For example, transversely outermost connectors 212*b* may comprise fasteners 208 to fasten blade 14 thereto. One or more transversely inward connectors 212*a* may also, or alternatively, be fastened to blade 14 by one or more fasteners 208. In at least the depicted embodiment, blade 14 is fastened to connectors 212 at at least three locations—two transversely outward locations and one transversely central location. Fastener 208 may comprise, for example, a screw, post, clamp, and/or other fastening mechanism.

Drywalling tool 200 may be used substantially similarly to drywalling tool 1—namely, drywalling tool 200 may be applied against drywalling mud (e.g. drywalling mud 100) and advanced along such drywalling mud to smooth it. In operation, a user applies force to body 202 to move drywalling tool 200 in an advancement direction (e.g. advancement direction 120). This force causes blade 14 to pass across a portion of drywall mud with sufficient force to at least partially smooth said drywall mud.

In some embodiments, including the depicted embodiment, a user may apply force against body 200 in flexion directions 22, thereby causing pivoting movement of body 202 relative to blade 14. Such movement may cause flexion of blade 14 in flexion direction 22A. However, in circumstances where drywalling mud is applying force against blade 14 so as to cause flexion in flexion direction 22B, force applied by a user in flexion direction 22A may counteract the force of the drywalling mud and thus may serve to reduce the flexion of blade 14 (and increase the force exerted by blade 14 against the drywalling mud). A user may selectively increase or decrease the force applied against blades 14 by correspondingly increasing or decreasing the force applied against body 202 in flexion direction 22A (without necessarily adjusting the force exerted in the advancement direction).

INTERPRETATION OF TERMS

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to";

"connected", "coupled", or any variant thereof, means any connection or coupling, either direct or indirect, between two or more elements; the coupling or connection between the elements can be physical, logical, or a combination thereof; elements which are integrally formed may be considered to be connected or coupled;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the plural forms "blades", "mounts", and "directions" are used at various points in place of the term "one or more blades", "one or more mounts", and "one or both directions", respectively, and accordingly include the meaning of the singular forms "blade", "mount", and "direction", respectively (and vice-versa);

the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. Apparatus for smoothing unfinished dried drywall mud, the apparatus comprising:

a body;

a flexible blade assembly movably engaged with the body, the blade assembly extending in a transverse direction and flexible in a first flexion direction orthogonal to the transverse direction, the blade assembly having first and second locations spaced apart in the transverse direction and substantially fixed in the flexion direction relative to the body;

a plurality of blade biasing mechanisms distributed across the entire transverse direction of the blade assembly from a first transversely outermost edge of the blade assembly to a second transversely outermost edge of the blade assembly, the second transversely outermost edge opposed to the first transversely outermost edge, for applying force to the entire blade assembly, each blade biasing mechanism anchored to the blade assembly and biasing the blade assembly in the first flexion direction, wherein the plurality of blade biasing mechanisms is anchored at the first transversely outermost edge, along the entire transverse direction of the blade assembly, and at the second transversely outermost edge.

2. Apparatus according to claim 1 wherein the blade assembly is engageable with a plurality of blades, the plurality of blades comprising:

a first blade extending in the transverse direction; and a second blade extending in the transverse direction and spaced apart from the first blade in the flexion direction.

3. Apparatus according to claim 2 wherein the first blade comprises a rough edge for shaving drywall mud, the rough edge comprising one or more channels for the passage of excess drywall mud, and the second blade comprises a smooth edge for smoothing drywall mud, the smooth edge being relatively smooth in comparison to the rough edge.

4. Apparatus according to claim 2 wherein the blade assembly comprises one or more connectors, each of the one or more connectors engageable with each of the plurality of blades, the one or more connectors engageable with the plurality of blades at the first and second locations and at a third location of the blade assembly where the blade displacement member is coupled to the blade assembly.

5. Apparatus according to claim 4 comprising one or more biasing mechanisms, each biasing mechanism anchored to a connector of the one or more connectors at a biasing location of the blade assembly, wherein the one or more connectors are engageable with the plurality of blades at the one or more biasing locations.

6. Apparatus according to claim 5 wherein the one or more connectors comprise:

a first connector engageable with the plurality of blades at the first location;

a second connector engageable with the plurality of blades at the second location;

a third connector engageable with the plurality of blades at the third location.

7. Apparatus according to claim 6 comprising:

a first biasing mechanism anchored to a first bias connector, the first bias connector engageable with the plurality of blades at the first bias location;

a second bias mechanism anchored to a second bias connector, the second bias connector engageable with the plurality of blades at a second bias location;

the first and second bias mechanisms configured to bias the plurality of blades towards the support at the corresponding first and second bias locations.

8. Apparatus according to claim 7 wherein the first biasing location is located transversely between the blade adjustment mechanism and the first location and the second biasing location is located transversely between the blade adjustment mechanism and the second location.

9. Apparatus according to claim 4 wherein the one or more connectors comprise a plurality of rigid connectors and the blade assembly comprises one or more relatively flexible mounts connecting the one or more connectors.

10. Apparatus according to claim 7 wherein the first connector is slidably anchored to the body at the first location, the first connector having an engagement member receivable by a concavity defined in the body, the concavity extending substantially in the transverse direction and the engagement member slidable in the transverse direction while received by the concavity.

11. Apparatus according to claim 1 comprising:

a handle assembly for engaging a handle extending in a handle direction;

one or more support arms connected to the handle assembly and extending from the handle assembly to the body, the body rotatably connected to each of the one or more support arms so that the body is rotatable about an axis parallel to the transverse direction;

a handle biasing mechanism connected to the handle assembly and extending from the handle assembly to the body, the handle biasing mechanism biasing the body towards a rotational position wherein, when one or more blades are engaged with the blade assembly and a handle is engaged by the handle assembly, the one or more blades are offset from the handle direction by an offset angle.

12. Apparatus according to claim 1 wherein the first flexion direction is away from the body.

13. Apparatus according to claim 1 wherein at least one of the one or more blade biasing mechanisms comprises:

a rod having a first end anchored to the blade assembly and a second end opposite the first end, the second end retained in a cavity defined by the body; and a spring engaged between the blade assembly and the body, the spring biasing the blade assembly away from the body, the spring retained by the rod.

14. Apparatus according to claim 13 wherein the at least one of the one or more blade biasing mechanisms comprises a head engaged with the second end of the rod, the head retained by the cavity.

15. Apparatus according to claim 1 wherein the body is pivotably engaged with the blade assembly and the one or more blade biasing mechanisms do at least one of:

oppose pivoting movement of the body toward the blade assembly; and amplify pivoting movement of the body toward the blade assembly.

16. Apparatus according to claim 1 wherein the blade assembly comprises one or more connectors, each of the one or more connectors engageable with one or more blades, the one or more blades flexible in the first flexion direction while engaged with the one or more connectors.

17. Apparatus according claim 16 wherein the one or more blade biasing mechanisms comprise a first biasing mechanism and a second biasing mechanism, the first biasing mechanism having a greater spring constant than the second biasing mechanism.

18. Apparatus according to claim 17 wherein the first blade biasing mechanism is anchored to a first connector, the second blade biasing mechanism is anchored to a second connector, and the first connector permits relatively less flexion of the one or more blades than the second connector.

19. Apparatus according to claim 18 wherein the first blade biasing mechanism and first connector are located relatively transversely outwardly relative to the second blade biasing mechanism and second connector.

20. Apparatus according to claim 16 wherein the one or more connectors comprise a plurality of rigid connectors and the blade assembly comprises one or more relatively flexible mounts connecting the one or more connectors.

* * * * *